US006801728B2

(12) United States Patent
Taguchi et al.

(10) Patent No.: US 6,801,728 B2
(45) Date of Patent: Oct. 5, 2004

(54) IMAGE FORMING APPARATUS AND IMAGE FORMING METHOD

(75) Inventors: Keiichi Taguchi, Nagano-ken (JP); Toshihiko Yamazaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/372,658

(22) Filed: Feb. 25, 2003

(65) Prior Publication Data

US 2003/0175041 A1 Sep. 18, 2003

(30) Foreign Application Priority Data

Feb. 28, 2002 (JP) ..... 2002-052867
Feb. 28, 2002 (JP) ..... 2002-052868
Feb. 28, 2002 (JP) ..... 2002-052869

(51) Int. Cl.[7] ..... G03G 15/16
(52) U.S. Cl. ..... 399/66; 399/44; 399/302
(58) Field of Search ..... 399/66, 44, 302, 399/308, 303, 313, 314; 430/126

(56) References Cited

U.S. PATENT DOCUMENTS 4,403,866 A 9/1983 Falcoff et al.
5,604,567 A 2/1997 Dundas et al.
5,713,062 A 1/1998 Goodman et al.
5,897,239 A 4/1999 Caruthers, Jr. et al.
6,052,195 A 4/2000 Mestha et al.
6,125,247 A * 9/2000 Tsukida et al. ..... 399/66
6,330,407 B1 * 9/2000 Tsukida et al. ..... 399/66

FOREIGN PATENT DOCUMENTS

| | | | |
|---|---|---|---|
| CA | 1209669 A1 | | 8/1986 |
| EP | 0094218 A2 | | 11/1983 |
| EP | 0685962 A2 | | 12/1995 |
| ES | 8407083 A1 | | 11/1984 |
| JP | 58-204066 A | | 11/1983 |
| JP | 8-9180 A | | 1/1996 |
| JP | 11-153912 | * | 6/1999 |
| JP | 2000-075689 | * | 3/2000 |
| JP | 2000-284612 | * | 10/2000 |
| JP | 3453003 B2 | | 10/2003 |

OTHER PUBLICATIONS

European Search Report dated Apr. 22, 2004.

* cited by examiner

*Primary Examiner*—Sophia S. Chen
(74) *Attorney, Agent, or Firm*—Sughrue Mion, PLLC

(57) ABSTRACT

An intermediate transfer belt having a plurality of layers including a conductive layer, and having transfer area and a transfer protection area. A CPU sends a control signal to a primary transfer bias generating circuit, and applies a primary transfer bias upon the conductive layer of the intermediate transfer medium through a bias applying member. The CPU changes an output value of the primary transfer bias in accordance with a predetermined bias change condition when a secondary transfer is not ongoing and when a non-image area, in which there is no toner image transferred on the intermediate transfer belt, such as the transfer protection area is passing the primary transfer part.

17 Claims, 16 Drawing Sheets

IMAGE FORMING APPARATUS AND IMAGE FORMING METHOD

BACKGROUND OF THE INVENTION

1. Field of the Invention

The present invention relates to an image forming utilizing electrophotography, such as a printer, a copier machine and a facsimile machine.

2. Description of the Related Art

In a conventional image forming apparatus utilizing electrophotography, developing means adheres toner to an electrostatic latent image which is formed on a photosensitive member by exposure means, a toner image is accordingly formed and then transferred onto a transfer paper, and the toner image formed on the transfer paper is fixed by fixing means on the transfer paper. Known in particular as an apparatus which permits to form a color image is an image forming apparatus in which a toner image which is formed on a photosensitive member is primarily transferred onto an intermediate transfer medium and thus primarily transferred image which is on the intermediate transfer medium is secondarily transferred onto a transfer paper.

There are two typical types of color image forming apparatuses. An image forming apparatus of one of the two types comprises one photosensitive member for example. In such an image forming apparatus, toner images of different colors are created one after another on the photosensitive member while primarily transferring each toner image onto an intermediate transfer medium every time a toner image in each color is formed, a color toner image, which is an overlap of the toner images of the plurality of colors, is accordingly formed on the intermediate transfer medium, and thus formed color toner image is secondarily transferred onto a transfer paper, whereby a color image is obtained.

Known as an image forming apparatus of the other type is an image forming apparatus of the so-called tandem type in which a plurality of photosensitive members are disposed in a direction of rotational driving of an intermediate transfer medium which rotates such that the photosensitive members are faced with the intermediate transfer medium. In such an image forming apparatus, toner images in different colors are created on the respective photosensitive members, thus formed toner images are primarily transferred on the rotating intermediate transfer medium so as to superimpose the toner images on top of the other, and a color toner image resulting from the superimposition is secondarily transferred onto a transfer paper.

By the way, primary transfer described above is realized as a primary transfer bias is applied between an intermediate transfer medium and a photosensitive member for instance, while secondary transfer described above is realized as a secondary transfer bias is applied between the intermediate transfer medium and a secondary transfer member, which is disposed to face with the intermediate transfer medium, with a transfer paper for instance interposed between the intermediate transfer medium and the secondary transfer member.

Among known as this type requires to output different primary transfer bias values for the different colors, or change an output value of the primary transfer bias or the secondary transfer bias in accordance with an environmental condition such as a temperature, a humidity level, etc.

In a configuration that the primary transfer bias is controlled to a constant voltage, since a potential difference is maintained constant in a primary transfer unit, even when an output value of the secondary transfer bias changes during application of the primary transfer bias, the change does not influence primary transfer almost at all.

On the contrary, when an output value of the primary transfer bias changes during application of the secondary transfer bias, since an electric field between the intermediate transfer medium and the secondary transfer member changes, there is a risk that secondary transfer will become instable. Particularly in a configuration that the intermediate transfer medium comprises a plurality of layers including a conductive layer, since application of the primary transfer bias upon the intermediate transfer medium is application upon the entire intermediate transfer medium which is not limited to the primary transfer unit but also includes the secondary transfer unit, the change of the output value of the primary transfer bias exerts a large influence over secondary transfer.

Hence, it is preferable to change the output value of the primary transfer bias in accordance with various conditions, since the materials of toner in the respective colors are different, since the toner in the respective colors is accumulated on the intermediate transfer medium, since the transfer efficiency changes because of a change in temperature or humidity, or for other reasons. It is also preferable to determine the timing of changing the output value of the primary transfer bias so that the timing will not adversely affect secondary transfer. However, the output value of the primary transfer bias needs be determined before starting primary transfer.

An image forming apparatus of the tandem type, a monochrome image forming apparatus or the like which comprises one photosensitive member in particular often uses a structure that an intermediate transfer medium moves passed a primary transfer unit immediately after moving passed a secondary transfer unit, in an attempt to reduce the size of the apparatus. Therefore, next primary transfer starts while secondary transfer is still ongoing depending on the size of a transfer paper, and the output value of the primary transfer bias will change during execution of secondary transfer but for countermeasure. Noting this, it is important to set up the timing of changing the output value of the primary transfer bias in such a manner that secondary transfer will not be negatively influenced.

SUMMARY OF THE INVENTION

A primary object of the present invention is to provide an image forming apparatus and an image forming method which prevent a change in output value of a primary transfer bias from adversely influencing secondary transfer in a configuration that an intermediate transfer medium comprises a plurality of layers including a conductive layer.

The present invention is directed to an image forming apparatus in which a toner image formed on a photosensitive member is transferred onto a transfer paper through an intermediate transfer medium which comprises a plurality of layers including a conductive layer and which moves from a primary transfer part to a secondary transfer part by rotation, said apparatus comprises: primary transfer means which primarily transfers the toner image from the photosensitive member onto the intermediate transfer medium in the primary transfer part by applying a primary transfer bias which is determined in advance upon the conductive layer of the intermediate transfer medium; secondary transfer means which secondarily transfers the toner image now on the intermediate transfer medium onto a transfer paper in the secondary transfer part; and bias control means which changes an output value of the primary transfer bias in accordance with a predetermined bias change condition when secondary transfer is not ongoing.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

<First Preferred Embodiment>

Figure 1:
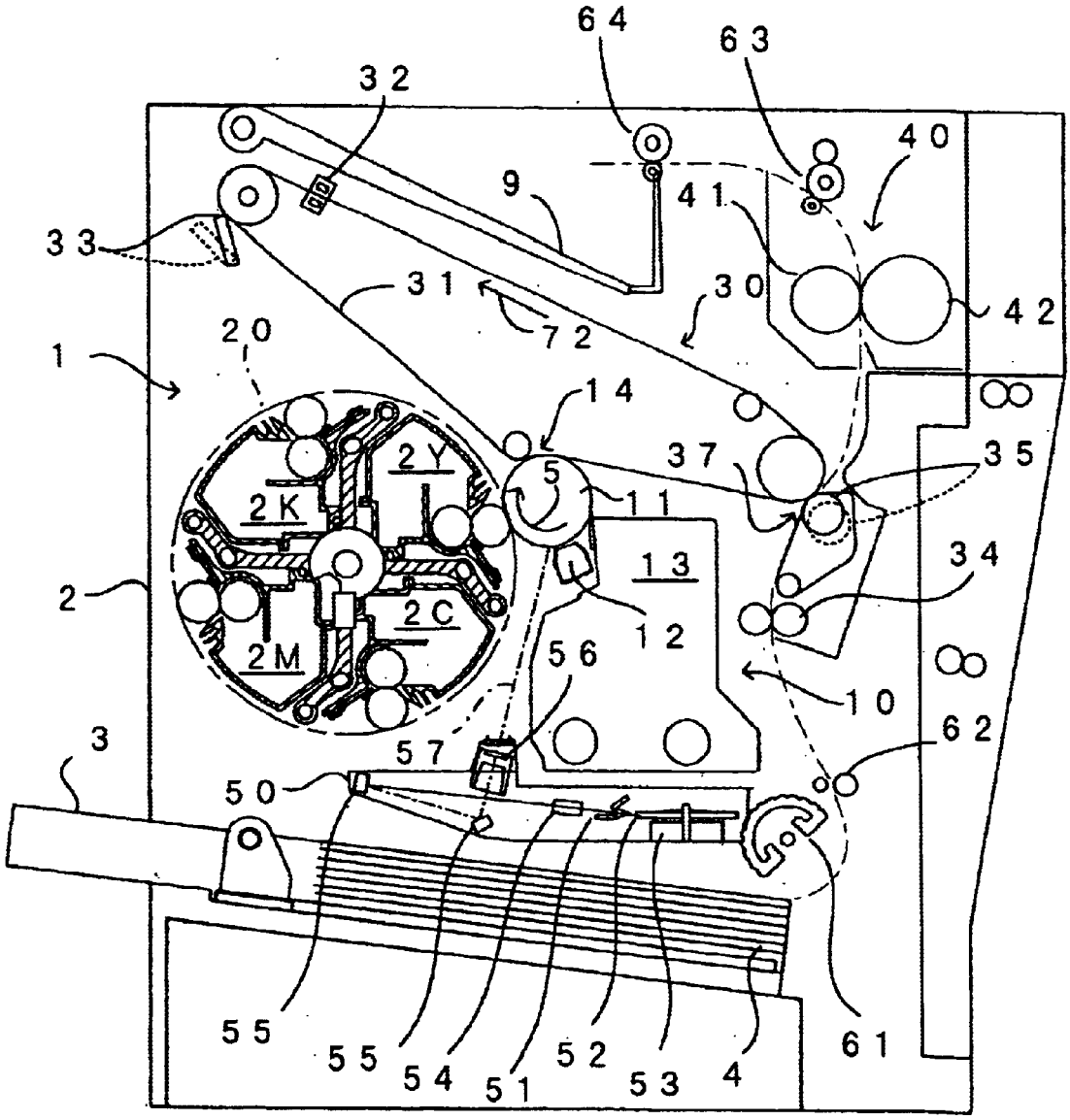
FIG. 1 is a drawing which shows an inner structure of a printer which is a preferred embodiment of an image forming apparatus according to the present invention.
Figure 2:
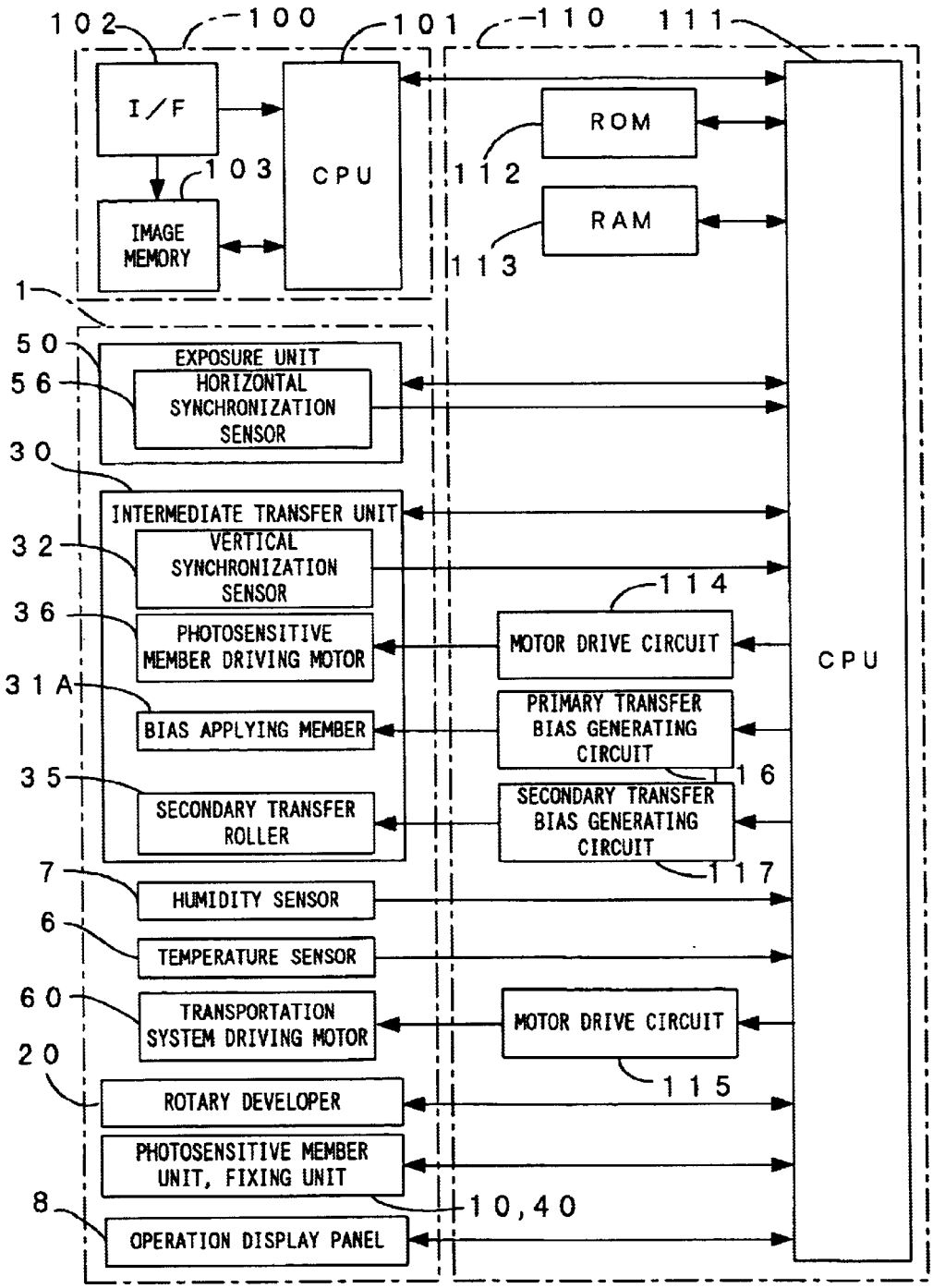
FIG. 2 is a block diagram which shows an electric structure of the printer.
Figure 3:
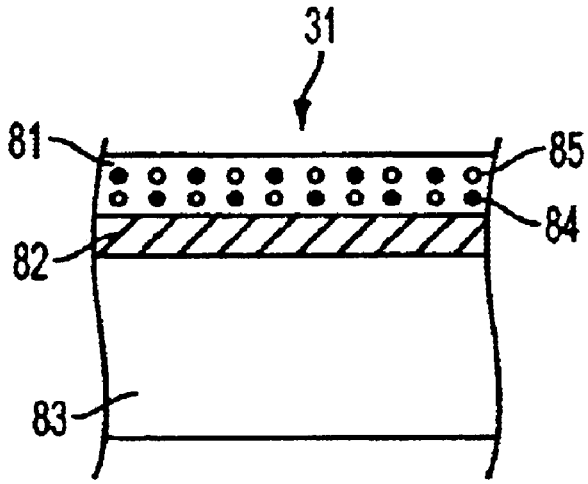
FIG. 3 is a cross sectional view of an intermediate transfer belt.
Figure 4A:
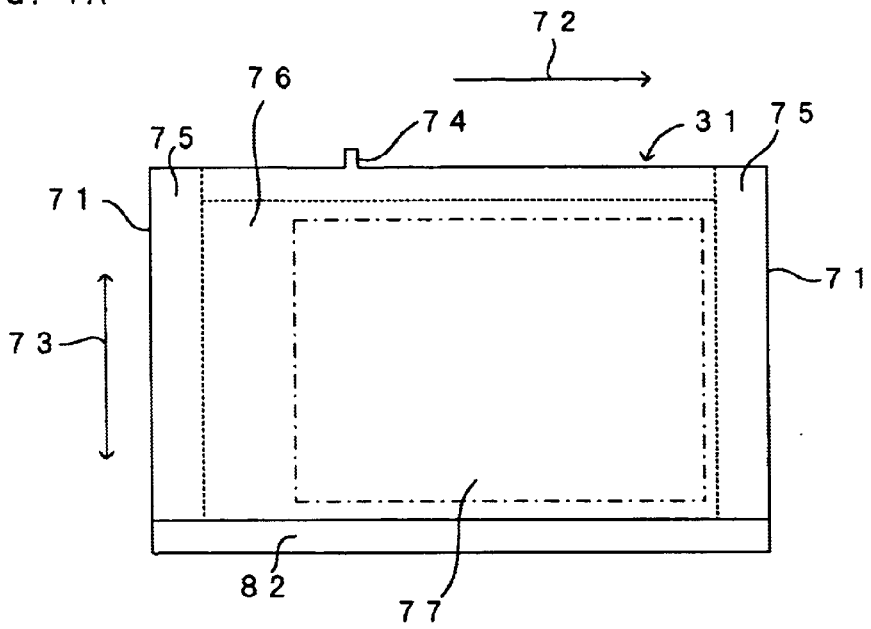
FIGS. 4A and 4B are development views of the intermediate transfer belt.
Figure 4B:
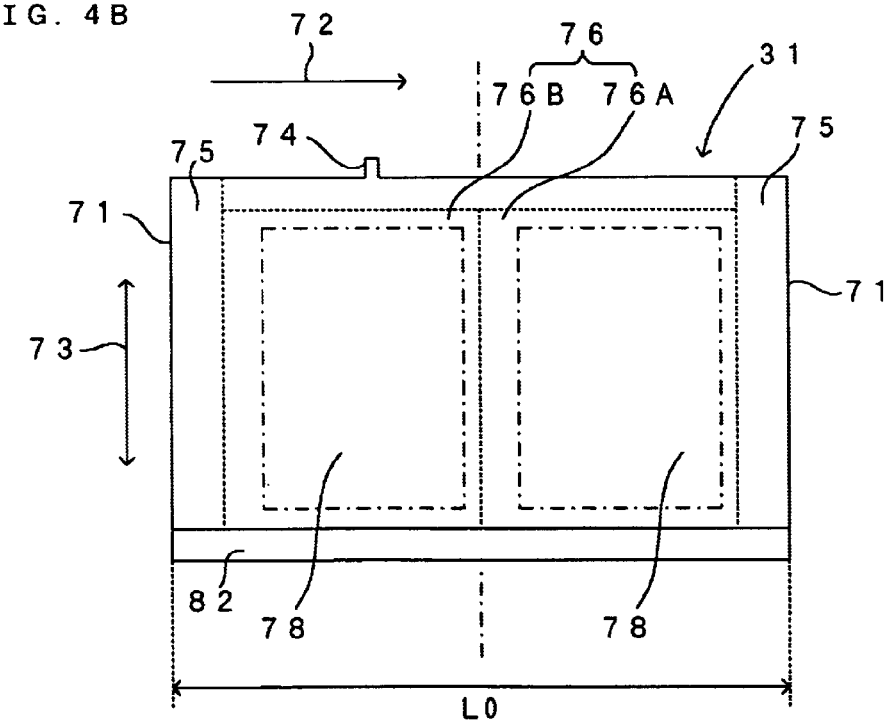
Figure 5:
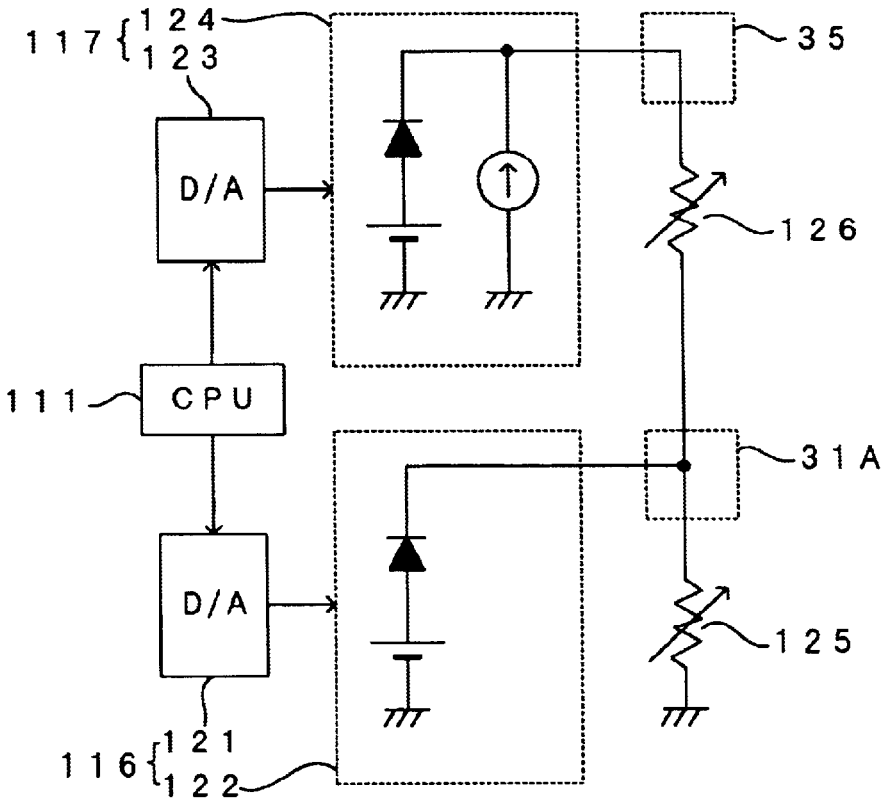
FIG. 5 is a drawing which schematically shows an example of a structure of a transfer bias generating circuit.

First, referring to FIGS. 1 through 5, a structure of a printer which is a preferred embodiment of an image forming apparatus according to the present invention will now be described. FIG. 1 is a drawing which shows an inner structure of the printer, FIG. 2 is a block diagram which shows an electric structure of the printer, FIG. 3 is a cross sectional view of an intermediate transfer belt, FIGS. 4A and 4B are development views of the intermediate transfer belt, and FIG. 5 is a drawing which schematically shows an example of a structure of a transfer bias generating circuit.

This printer is for superimposing toner in four colors, which are yellow (Y), magenta (M), cyan (C) and black (K), and thereby forming a full color image, or for forming a single-color image using only toner in the black color (K) for instance. In this printer, when a print instruction signal containing a video signal is fed to a main controller 100 from an external apparatus such as a host computer, an engine controller 110 controls each portion of an engine part 1 in accordance with a control signal from the main controller 100, and the printer prints out an image corresponding to the video signal on a transfer paper 4 transported from a paper feeding cassette 3 which is disposed in a lower section of a main unit 2.

The engine part 1 comprises a photosensitive member unit 10, a rotary developer 20, an intermediate transfer unit 30, a fixing unit 40, and an exposure unit 50. The photosensitive member unit 10 comprises a photosensitive member 11, an electrifier 12 and a cleaner 13. The rotary developer 20 comprises a yellow developer unit 2Y housing yellow toner, a magenta developer unit 2M housing magenta toner, a cyan developer unit 2C housing cyan toner, a black developer unit 2K housing black toner, etc. The intermediate transfer unit 30 comprises an intermediate transfer belt 31, a vertical synchronization sensor 32, a belt cleaner 33, a gate roller pair 34, a secondary transfer roller 35, a photosensitive member driving motor 36, etc. These seven units 10, 2Y, 2M, 2C, 2K, 30 and 40 are formed so that these units can be freely attached to and detached from the main unit 2.

This printer has such a structure which allows to primarily transfer a toner image currently on the photosensitive member 11 onto the intermediate transfer belt 31 and secondarily transfer the primarily transferred toner image onto the transfer paper 4. An output value of a primary transfer bias is changed in accordance with a predetermined bias changing condition.

With the seven units 10, 2Y, 2M, 2C, 2K, 30 and 40 described above mounted to the main unit 2, the photosensitive member 11 of the photosensitive member unit 10 is rotated by the photosensitive member driving motor 36 in the direction of an arrow 5. Along the rotating direction 5 of the photosensitive member 11, the electrifier 12, the rotary developer 20 and the cleaner 13 are disposed around the photosensitive member 11.

The electrifier 12 comprises a wire electrode to which a high voltage at a predetermined level is applied. Utilizing corona discharge for instance, the electrifier 12 uniformly electrifies an outer circumferential surface of the photosensitive member 11. The cleaner 13 is disposed on the upstream side to the electrifier 12 in the rotating direction 5 of the photosensitive member 11. The cleaner 13 scrapes off toner which remains on the outer circumferential surface of the photosensitive member 11 after primary transfer of a toner image onto the intermediate transfer belt 31 from the photosensitive member 11, to thereby clean the surface of the photosensitive member 11.

The exposure unit 50 comprises a laser light source 51 which is formed by a semiconductor laser for instance, a polygon mirror 52 which reflects laser light from the laser light source 51, a scanner motor 53 which drives the polygon mirror 52 so that the polygon mirror 52 rotates at a high speed, a lens part 54 which converges the laser light reflected by the polygon mirror 52, a plurality of reflection mirrors 55, a horizontal synchronization sensor 56, etc. Leaving the lens part 54 and the reflection mirrors 55 after reflected by the polygon mirror 52, laser light 57 scans the surface of the photosensitive member 11 in a main scanning direction (a direction which is perpendicular to the plane of FIG. 1), whereby an electrostatic latent image corresponding to the video signal is formed on the surface of the photosensitive member 11. At this stage, the horizontal synchronization sensor 56 provides a synchronizing signal which is in the main scanning direction, i.e., a horizontal synchronizing signal. The exposure unit 50 functions as exposure means.

The rotary developer 20 is for making the toner in the respective colors adhere to the electrostatic latent image to thereby develop the electrostatic latent image. The yellow developer unit 2Y, the magenta developer unit 2M, the cyan developer unit 2C and the black developer unit 2K of the rotary developer 20 are disposed for free rotations about an axis. These developer units 2Y, 2M, 2C and 2K are movable to a plurality of predetermined positions, and are selectively located at an abutting position on the photosensitive member 11 and a separated position from the photosensitive member 11. When a developing bias is applied which is a direct current component as it is alone or a direct current component on which an alternating current component is superimposed, from the developer unit which is at the abutting position relative to the photosensitive member 11, the toner in the corresponding color adheres to the surface of the photosensitive member 11. The rotary developer 20 functions as developing means.

The intermediate transfer belt 31 of the intermediate transfer unit 30 stretches around a plurality of rollers, and is driven by the photosensitive member driving motor 36 and accordingly rotates together with the photosensitive member 11. As shown in the cross sectional view in FIG. 3, the intermediate transfer belt 31 is formed by a resistance layer 81 on the surface, a conductive layer 82 which is in the middle, and a base material portion 83 which is the bottom most layer. The resistance layer 81 is made of synthetic resin (which may be urethane resin for instance) having predetermined thickness (which may be 20 $\mu$m for instance), and contains conductive particles ($SnO_2$ for instance) 84, fluororesin (polytetrafluoroethylene for instance) particles 85, etc. The resistance value of the resistance layer 81 is set to about $10^8$ through $10^{14}$ $\Omega$ since the conductive particles 84 are contained while frictional resistance is suppressed since the fluororesin particles 85 are contained, thereby preventing locking of the intermediate transfer belt 31 by the belt cleaner 33 (which will be described later).

The conductive layer 82 is formed by deposition of aluminum for example. The base material portion 83 has predetermined thickness (100 $\mu$m for instance), and is made of synthetic resin (which may be polyethylene terephthalate for instance). In this manner, a cost is reduced as the resistance layer 81 and the conductive layer 82, which are layers realizing an electric function, are separated from the base material portion 83 which is a layer for providing mechanical strength.

In addition, as shown in the development views in FIGS. 4A and 4B, the intermediate transfer belt 31 is formed as an endless belt which is obtained by joining an approximately rectangular sheet at a splice 71 so as to span over the length L0. In FIGS. 4A and 4B, an arrow 72 denotes a direction of rotational driving, while an arrow 73 denotes a direction of rotation axis. On one edge side along the direction of rotation axis 73 (on the top side in FIGS. 4A and 4B), a projection 74 is disposed to the intermediate transfer belt 31.

The intermediate transfer belt 31 contains a transfer protection area 75 and a transfer area 76. The transfer protection area 75 is defined across one edge and the other edge along the direction of rotation axis 73 and within a predetermined range which stretches on the both sides to the splice 71, and in the transfer protection area 75, primary transfer of a toner image is prohibited. The transfer area 76 is an area other than the transfer protection area 75, and expands in a rectangular area except for a one edge portion and other edge portion along the direction of rotation axis 73. The transfer area 76 has a larger size than that of an A3 paper as it is placed with the longer sides aligned along the direction of rotational driving 72. As shown in FIG. 4A, it is possible to transfer an image 77 whose size is that of an A3 paper as it is placed with the longer sides aligned along the direction of rotational driving 72. Further, as shown in FIG. 4B, the transfer area 76 can be split into two sub areas 76A and 76B. Therefore it is possible to transfer two images 78 each having the size of an A4 paper with the shorter sides aligned along the direction of rotational driving 72, while the intermediate transfer belt 31 rotates one round.

As shown in FIGS. 4A and 4B, the conductive layer 82 is exposed at the surface on the other edge side (the bottom side in FIGS. 4A and 4B) of the intermediate transfer belt 31 along the direction of rotation axis 73. A primary transfer bias is applied to the exposed portion through a bias applying member 31A (See FIG. 2.) so that a toner image on the photosensitive member 11 will be primarily transferred onto the intermediate transfer belt 31 because of this primary transfer bias. The abutting position at which the photosensitive member 11 contacts the intermediate transfer belt 31 is provided within a primary transfer part 14.

Referring to FIGS. 1 and 2 again, the vertical synchronization sensor 32 is formed by a photo-interrupter which comprises a light emitter (such as an LED) and a light receiver (such as a photo diode) which are disposed so as to face each other for instance. The vertical synchronization sensor 32 is disposed on the one edge side of the rotating intermediate transfer belt 31 along the direction of rotation axis 73 and detects a passage of the projection 74. The resulting detection signal is used as a vertical synchronizing signal (reference signal) which the engine controller 110 refers to when controlling formation of an image. The belt cleaner 33 is disposed so as to be switched by a cleaner contacting/clearing clutch between an abutting state (denoted by the solid line in FIG. 1) abutting on the intermediate transfer belt 31 and a cleared-off state (denoted by the dotted line in FIG. 1). In the abutting state, the belt cleaner 33 scrapes off toner which remains on the intermediate transfer belt 31. When a gate clutch is turned on, the drive force of a transportation system driving motor 60 is transmitted to the gate roller pair 34 and the gate roller pair 34 accordingly rotates.

A contacting/clearing clutch for secondary transfer roller switches the secondary transfer roller 35 between an abutting state (denoted by the solid line in FIG. 1) abutting on the intermediate transfer belt 31 and a cleared-off state (denoted by the dotted line in FIG. 1). When applied with a predetermined secondary transfer bias in the abutting state abutting on the intermediate transfer belt 31, the secondary transfer roller 35 secondarily transfers a primarily transferred toner image currently on the intermediate transfer belt 31 onto the transfer paper 4 while the transfer paper 4 is transported. This abutting position is located in a secondary transfer part 37.

The fixing unit 40 comprises a heating roller 41 and a pressure roller 42, and fixes a toner image on the transfer paper 4 by a heating roller fixing method while transporting the transfer paper 4 so that the toner image will be fixed to the transfer paper 4. The fixing unit 40 therefore constitutes fixing means.

A crescent-shaped pick-up roller 61 and a feed roller pair 62 are disposed toward above from the front edge of the paper feeding cassette 3 (the right-most edge in FIG. 1), and on the opposite side to the gate roller pair 34, the secondary transfer roller 35 and the fixing unit 40, a transportation roller pair 63 and a discharge roller pair 64 are disposed, whereby a transportation path for the transfer papers 4 (denoted at the chain line in FIG. 1) is formed. The transfer papers 4 discharged by the discharge roller pair 64 accumulate in a discharging part 9.

The pick-up roller 61 is driven by a pick-up solenoid. The feed roller pair 62, the gate roller pair 34, the secondary transfer roller 35, the fixing unit 40, the heating roller 41, the transportation roller pair 63 and the discharge roller pair 64 are each linked to the same transportation system driving motor 60 via a drive force transmission mechanism. When a feed clutch is turned on, the drive force of the transportation system driving motor 60 is transmitted to the feed roller pair 62, and the feed roller pair 62 accordingly rotates. The transportation system driving motor 60 transports the transfer paper 4 at a predetermined transportation speed. The feed roller pair 62, the gate roller pair 34, the transportation roller pair 63 and the discharge roller pair 64 constitute transporting means for the transfer papers 4.

The engine part 1 comprises a temperature sensor 6 which detects the temperature of an atmosphere and a humidity sensor 7 which detects the humidity level of the atmosphere. The temperature sensor 6 and the humidity sensor 7 respectively constitute temperature detecting means and humidity detecting means each serving as environment condition detecting means.

In FIG. 2, the main controller 100 comprises a CPU 101, an interface 102 which transfers a control signal with the external apparatus such as a host computer, and an image memory 103 which stores the video signal received through the interface 102. Upon receipt of the print instruction signal containing the video signal from the external apparatus via the interface 102, the CPU 101 converts the same into job data which are in a format appropriate to provide the engine part 1 with an instruction for operation, and sends the data to the engine controller 110.

The engine controller 110 comprises the CPU 111, a ROM 112, a RAM 113, etc. The ROM 112 stores a control program of the CPU 111, etc. The RAM 113 temporarily stores control data of the engine part 1, a result of computation by the CPU 111, etc.

As input signals from the engine part 1, the CPU 111 receives the vertical synchronizing signal Vsync from the vertical synchronization sensor 32, the horizontal synchronizing signal Hsync from the horizontal synchronization sensor 56, and information regarding environment conditions, i.e., the temperature of the atmosphere and the humidity level of the atmosphere, from the temperature sensor 6 and the humidity sensor 7. Based on these input signals and the control program, the CPU 111 controls operations of the respective portions of the engine part 1.

That is, the CPU 111 sends a control signal to a motor drive circuit 114 which drives the photosensitive member driving motor 36, synchronizes the photosensitive member 11 and the intermediate transfer belt 31 to each other, and drives these. Further, the CPU 111 sends a control signal to a motor drive circuit 115 which drives the transportation system driving motor 60, and controls feeding of the transfer paper 4 from the paper feeding cassette 3.

In addition, the CPU 111 sends a control signal to a drive circuit which drives the cleaner contacting/clearing clutch, and controls clearing off of the belt cleaner 33 from the intermediate transfer belt 31 and abutting of the belt cleaner 33 on the intermediate transfer belt 31. Still further, the CPU 111 sends a control signal to a drive circuit which drives the contacting/clearing clutch for secondary transfer roller, and controls clearing off of the secondary transfer roller 35 from the intermediate transfer belt 31 and abutting of the secondary transfer roller 35 on the intermediate transfer belt 31.

The CPU 111 receives the content of an operation made on an operating key of an operation display panel 8 which is disposed on the surface of the main unit 2 for instance, and controls the content of what is displayed on a display part. When two or more images are to be formed in a size which can be transferred two images during one rotation of the intermediate transfer belt 31 (for instance, the A4 size or smaller size with the shorter sides aligned along the direction of rotational driving 72), the CPU 111 controls formation of images on the photosensitive member 11 such that toner images will be transferred one in the sub area 76A and the other in the sub area 76B within the transfer area 76.

Still further, the CPU 111 sends a control signal to a primary transfer bias generating circuit 116 which generates the primary transfer bias, to thereby control application of the primary transfer bias upon the intermediate transfer belt 31. The CPU 111 sends a control signal also to a secondary transfer bias generating circuit 117 which generates the secondary transfer bias, to thereby control application of the secondary transfer bias upon the secondary transfer roller 35.

As shown in FIG. 5, the CPU 111 sends control data to a D/A convertor 121 of the primary transfer bias generating circuit 116. The D/A convertor 121 is for control of a drive part 122 based on the control data received from the CPU 111. The D/A convertor 121 controls the drive part 122 to a constant voltage (which is a voltage value which is set in advance within a range of about 50 to 400 V for instance), and hence, application of the primary transfer bias.

Further, the CPU 111 sends control data to a D/A convertor 123 of the secondary transfer bias generating circuit 117. The D/A convertor 123 is for control of a drive part 124 based on the control data received from the CPU 111. By means of constant current (a current value which is set in advance within a range of about 1 to 100 $\mu$A for instance) control added with lower limit voltage (a voltage value which is set in advance within a range of about 500 to 3000 V for instance) control, the D/A convertor 123 controls application of the secondary transfer bias. In other words, voltage control is performed until a lower limit voltage is reached and constant current control is thereafter performed.

In FIG. 5, a load 125 is equivalent to the resistance components of the photosensitive member 11, the bias applying member 31A and the like, and a load 126 is equivalent to the resistance components of the secondary transfer roller 35, the intermediate transfer belt 31 and the like.

The CPU 111 also serves to change the output value of the primary transfer bias to the D/A convertor 121 as described below. In this embodiment in particular, when a non-image area on the intermediate transfer belt 31 bearing no transferred toner image is moving through the primary transfer part 14 and secondary transfer is not ongoing, the CPU 111 changes the output value of the primary transfer bias in accordance with a predetermined bias change condition.

The "non-image area" is the transfer protection area 75 for instance. Alternatively, the non-image area may merely be an area onto which no toner image has been transferred and which contains the transfer protection area 75. Further, mentioned as "a non-image area is moving passed the primary transfer part 14" is a state that the rear edge of the transfer protection area 75, namely, the front edge of the transfer area 76 (the downstream edge along the direction of rotational driving 72) for example has yet arrived at the primary transfer part 14.

Used as the predetermined bias change conditions described above are environment conditions including the temperature of the atmosphere and the humidity level of the atmosphere obtained by the temperature sensor 6 and the humidity sensor 7. Also used as the predetermined bias change conditions for formation of a color image is the order of primary transfer of the toner which will be superimposed with each other on the intermediate transfer belt 31, and the output value of the primary transfer bias is changed for every primary transfer of a toner image.

Even when it is not necessary to change the output value of the primary transfer bias in accordance with the bias change conditions, the CPU 111 sends control data to the D/A convertor 121 of the primary transfer bias generating circuit 116. Hence, even if a noise for example creates a garbage content in the control data fed to the D/A convertor 121, it is possible to prevent the primary transfer bias generating circuit 116 from continuously operating using such abnormal data.

The intermediate transfer belt 31 corresponds to an intermediate transfer medium, while the bias applying member 31A and the primary transfer bias generating circuit 116 correspond to primary transfer means, and the secondary transfer roller 35 and the secondary transfer bias generating circuit 117 correspond to secondary transfer means. Meanwhile, the CPU 111 corresponds to bias control means, toner image formation control means, bias change judging means and second transfer judging means.

Figure 6:
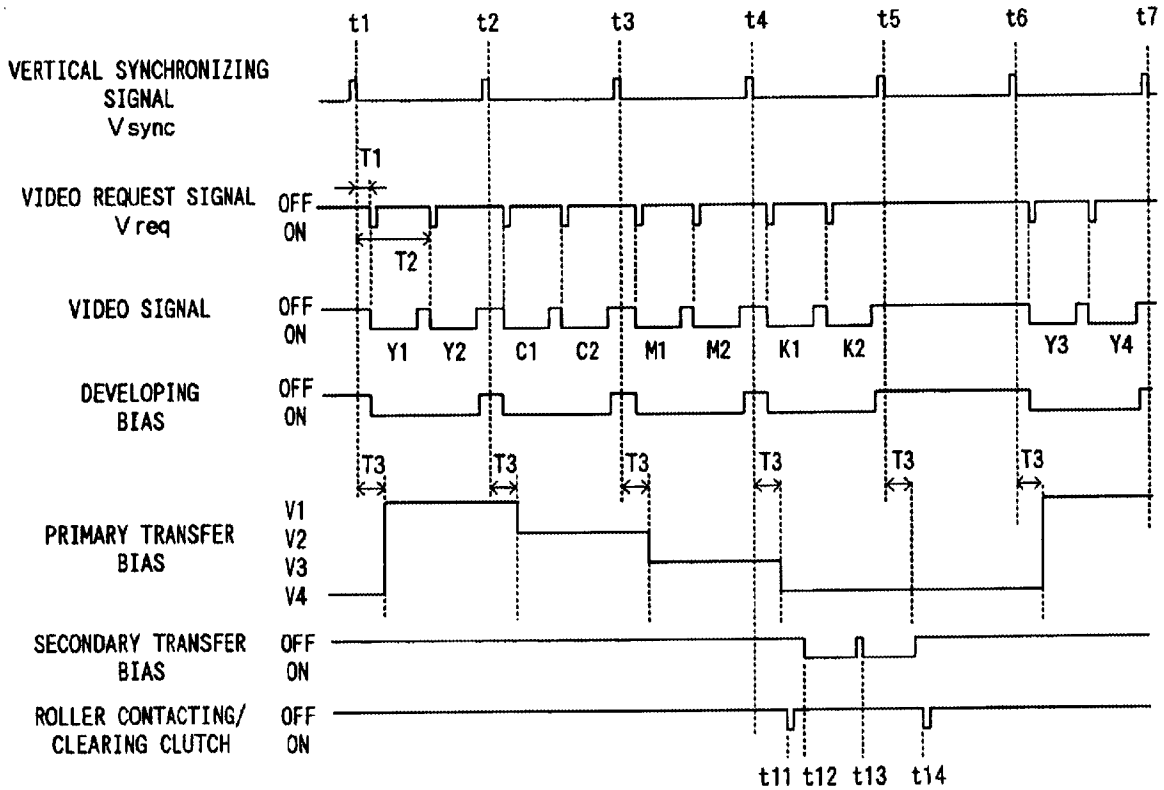
FIG. 6 is a timing chart for describing operations, which shows time-induced changes appearing in the conditions of the respective portions of an engine part.

Referring to FIG. 6, an operation of this printer will now be described. FIG. 6 is a timing chart which shows time-induced changes appearing in the conditions of the respective portions of the engine part 1. The illustrate example is a situation that four images of such a size that can be transferred two images during one rotation of the intermediate transfer belt 31 are to be formed, and therefore, the output value of the primary transfer bias is changed for every primary transfer of a toner image which will be superimposed. The video signal is activated in response to a video request signal Vreq and in synchronization to the rotating intermediate transfer belt 31, and therefore, the timing of the turning on of the video signal is in a predetermined delay from the timing of the video request signal Vreq. However, for convenience of illustration, the video signal turns on in synchronization to the video request signal Vreq in FIG. 6.

As the print instruction signal containing the video signal is fed to the main controller 100 from the external apparatus such as a host computer, in response to the control signal received from the main controller 100, the engine controller 110 starts operating the respective portions of the engine part 1. At this stage, if the size of the transfer papers 4 stacked up in the paper feeding cassette 3 fails to match with the size designated by the print instruction signal, the operation display panel 8 shows a message which encourages to replace the paper feeding cassette. Although FIG. 1 shows the printer as a printer which comprises one paper feeding cassette 3, this is not limiting. Instead, the printer may comprise a plurality of paper feeding cassettes.

When the size of the transfer papers 4 stacked up in the paper feeding cassette 3 matches with the size designated by the print instruction signal, by means of the laser light 57 emitted from the exposure unit 50, an electrostatic latent image corresponding to the video signal described above is formed on the surface of the photosensitive member 11 which is uniformly electrified by the electrifier 12. The rotary developer 20 develops the electrostatic latent image, thereby forming a toner image. In the primary transfer part 14, the toner image thus formed on the photosensitive member 11 is primarily transferred onto the intermediate transfer belt 31.

That is, the photosensitive member driving motor 36 rotates the intermediate transfer belt 31 at a predetermined peripheral velocity, and the vertical synchronizing signal Vsync is outputted at the time t1, t2, t3, t4, t5, t6 and t7 as shown in FIG. 6. After a predetermined period T1 since the falling edges of the vertical synchronizing signal Vsync at t1, t2, t3 and t4, the video request signal Vreq for the first image is outputted. In synchronization to falling of this video request signal Vreq, formation of an electrostatic latent image corresponding to the video signal representing the first image is started, concurrently with which the developing bias is turned on. Meanwhile, after a predetermined period T2 (>T1) since the falling edges of the vertical synchronizing signal Vsync, the video request signal Vreq for the second image is outputted. In synchronization to falling of this video request signal Vreq, formation of an electrostatic latent image corresponding to the video signal representing the second image is started.

The developing units of the rotary developer 20 switch over with each other at the time t1, t2, t3 and t4, whereby toner images in the respective colors are formed on the photosensitive member 11 and primarily transferred one after another onto the intermediate transfer belt 31. At this stage, after a predetermined period T3 from the time t1, t2, t3 and t4, the output value from the primary transfer bias generating circuit 116 is changed.

In this embodiment, the primary transfer bias for the first image (Y) is set to a voltage V1 (V1=220 V for example), the primary transfer bias for the second image (C) is set to a voltage V2 (V2=245 V for example), the primary transfer bias for the third image (M) is set to a voltage V3 (V3=270 V for example), and the primary transfer bias for the fourth image (K) is set to a voltage V4 (V4=300 V for example).

The predetermined period T3 is set in advance such that changing of the primary transfer bias to be applied upon the intermediate transfer belt 31 will have completed before the front edge of a toner image on the photosensitive member 11 which was formed to match in terms of timing with the sub area 76A of the intermediate transfer belt 31 (the downstream edge along the direction of rotational driving 72) reaches the primary transfer part 14 (i.e., while the transfer protection area 75 serving as the non-image area is moving through the primary transfer part 14). Further, since secondary transfer is not ongoing after the predetermined period T3 since the time t1, t2, t3 and t4, the output value of the primary transfer bias is changed to V1, V2, V3 and V4, respectively.

Since the secondary transfer roller 35 stays cleared off from the intermediate transfer belt 31 during this, the toner images in the respective colors are superimposed one atop the other on the intermediate transfer belt 31. The developing bias is turned off after a predetermined period of time which is determined in advance depending on the size of the transfer papers since the falling edges of the vertical synchronizing signal Vsync at the time t1, t2, t3 and t4.

As a result, a color image which is toner images Y1, C1, M1 and K1 as they are superimposed one atop the other is primarily transferred onto the sub area 76A which is on the downstream side in the transfer area 76 of the intermediate transfer belt 31 along the direction of rotational driving 72, and a color image which is toner images Y2, C2, M2 and K2 as they are superimposed one atop the other is primarily transferred onto the sub area 76B which is on the upstream side in the transfer area 76 of the intermediate transfer belt 31 along the direction of rotational driving 72.

On the other hand, the top-most transfer paper 4 among the bundle of transfer papers housed in the paper feeding cassette 3 is taken out by the pick-up roller 61, transported by the feed roller pair 62 at a predetermined speed, and nipped by the gate roller pair 34. The gate clutch turns on in synchronization to a toner image on the intermediate transfer belt 31, and the transfer paper 4 is transported toward the secondary transfer part 37 from the gate roller pair 34 at a predetermined speed.

The contacting/clearing clutch for secondary transfer roller turns on at the time till which is after a predetermined period from the time t4, and the secondary transfer roller 35 accordingly abuts on the intermediate transfer belt 31. Following this, at the time t12 which is after a predetermined period since the time t4, application of the secondary transfer bias from the secondary transfer bias generating circuit 117 upon the secondary transfer roller 35 is activated.

This realizes transfer onto the first transfer paper 4 of the color image which is the toner images Y1, C1, M1 and K1 as they are superimposed one atop the other and which was primarily transferred onto the sub area 76A which is on the downstream side in the transfer area 76 of the intermediate transfer belt 31 along the direction of rotational driving 72.

The gate clutch is temporarily turned off after discharging of the first transfer paper 4. A period during which the secondary transfer bias is applied is set in advance in accordance with the size of the transfer papers 4. At this stage, the next transfer paper 4 is taken out by the pick-up roller 61, transported by the feed roller pair 62 at a predetermined speed, and nipped by the gate roller pair 34.

After turning off of the gate clutch and inactivation of application of the secondary transfer bias, the gate clutch turns on in synchronization to the next toner image and the next transfer paper 4 is transported, and application of the secondary transfer bias turns on at the time t13 which is after a predetermined period since the time t4. When the preset period during which the secondary transfer bias is applied elapses, application of the secondary transfer bias turns off, and at the time t14 which is after a predetermined period since the time t4, the contacting/clearing clutch for secondary transfer roller turns on and the secondary transfer roller 35 leaves the intermediate transfer belt 31.

This realizes transfer onto the second transfer paper 4 of the color image which is toner images Y2, C2, M2 and K2 as they are superimposed one atop the other and which was primarily transferred onto the sub area 76B which is on the upstream side in the transfer area 76 of the intermediate transfer belt 31 along the direction of rotational driving 72.

In the fixing unit 40, this toner image is fixed on the transfer paper during transportation of the transfer paper 4. The transfer paper 4 is further transported by the transportation roller pair 63 and discharged by the discharge roller pair 64 into the discharging part 9 which is disposed to an upper section of the main unit 2.

While the third and the fourth images are formed on the photosensitive member 11 following this, since the period during which the secondary transfer bias is applied is determined in advance in accordance with the size of the transfer papers 4, at the time t5 which is the next outputting of the vertical synchronizing signal Vsync, it is already possible to determine whether the secondary transfer bias is on after the predetermined period T3 from the time t5. In FIG. 6, since the secondary transfer bias is on after the predetermined period T3 from the time t5, the output value of the primary transfer bias is not changed, and therefore, formation of image is held off by the time t6 at which the vertical synchronizing signal Vsync is outputted next time.

After a predetermined period since the time t6, toner images Y3 and Y4 are formed which are to form the third and the fourth images, and after the predetermined period T3 since the time t6, the output value of the primary transfer bias is changed to V1 and an operation similar to the above is performed.

As described above, during the operations shown in FIG. 6, since changing of the output value of the primary transfer bias completes while the transfer protection area 75 serving as the non-image area is still moving through the primary transfer part 14, it is possible to change the output value without fail prior to the start of primary transfer.

Further, since the primary transfer bias is changed for every primary transfer of a toner image, it is possible to primarily transfer the toner of the respective colors onto the intermediate transfer belt 31 in an excellent manner in accordance with the toner transfer efficiency which changes depending on the thickness of the stacked-up toner on the intermediate transfer belt 31, and hence, to obtain a color image having a high image quality on the transfer paper 4.

In addition, since the output value of the primary transfer bias is changed when secondary transfer is not ongoing, it is possible to prevent a change to the primary transfer bias from adversely affecting secondary transfer, and hence, the quality of an image transferred onto the transfer paper 4 from deteriorating.

Figure 7:
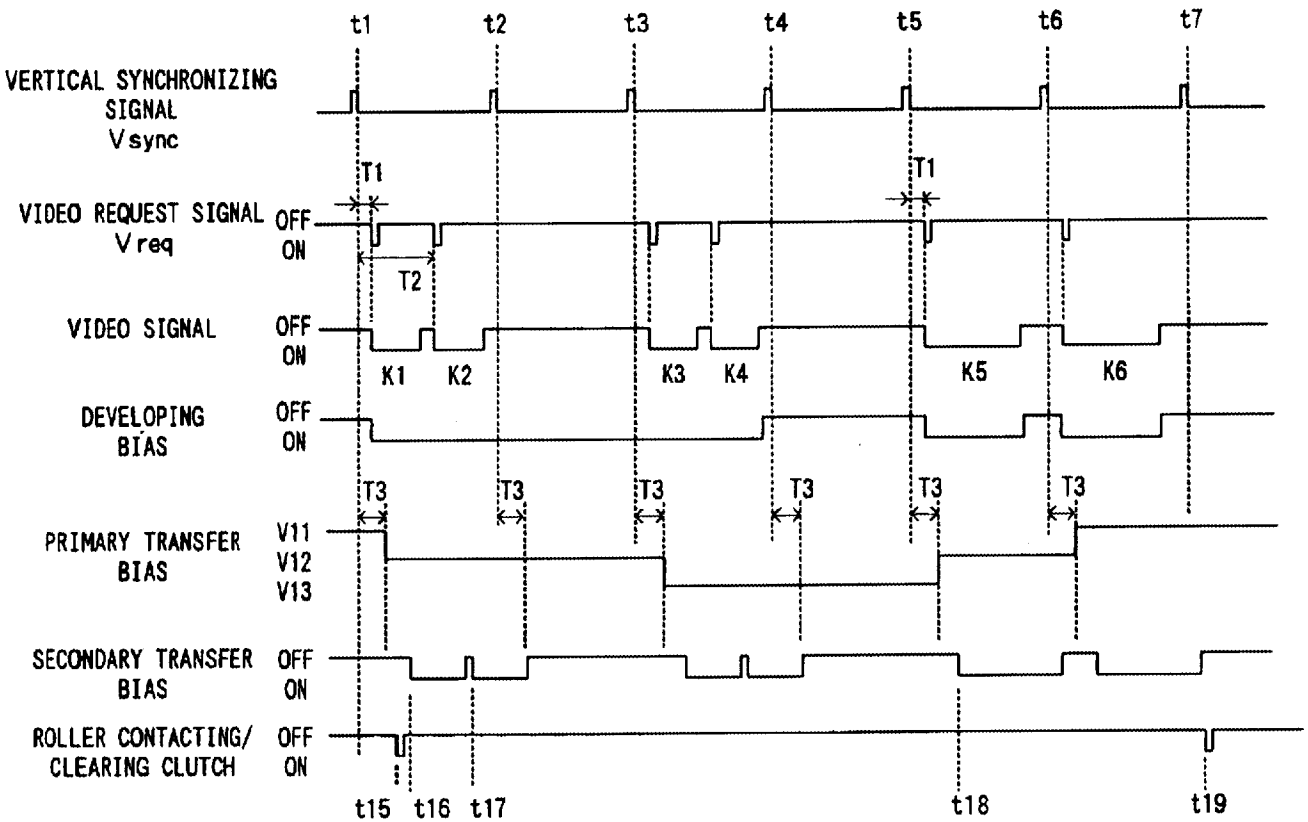
FIG. 7 is a timing chart for describing other operations, which shows time-induced changes appearing in the conditions of the respective portions of the engine part.

Referring to FIG. 7, other operations of this printer will now be described. FIG. 7 is a timing chart which shows time-induced changes appearing in the conditions of the respective portions of the engine part 1. The illustrate example is a situation that one wishes to form four images of such a size that can be transferred two images during one rotation of the intermediate transfer belt 31 as monochrome images and then to form a monochrome image whose size permits to be transferred only one image during one rotation of the intermediate transfer belt 31 (e.g., the A3 size). The same symbols as those used in FIG. 6 denote the same timing. For convenience of illustration, FIG. 7 shows as if the video signal turns on in synchronization to the video request signal Vreq as in FIG. 6.

In FIG. 7, the primary transfer bias is changed depending on the environment conditions representing the temperature and the humidity level. For convenience of description, the output value is changed always at the timing of changing the primary transfer bias assuming that there is a change to the environment conditions. Further, FIG. 7 assumes that the printer comprises two paper feeding cassettes 3 in which the transfer papers 4 of the sizes described above are held. In addition, since a monochrome image (in K for instance) is formed in FIG. 7, the black developer unit 2K remains to serve as the rotary developer 20. Hence, the developing bias stays turned on until an image has been formed. Since superimposition of toner images is not performed, until an image has been formed, the secondary transfer roller 35 is maintained abutting on the intermediate transfer belt 31.

The table below shows one example of the output value of the primary transfer bias in accordance with the environment conditions representing the temperature and the humidity level during the operation shown in FIG. 7. In Table 1, the symbol TP denotes the temperature while the symbol HM denotes the humidity. Since the transfer efficiency decreases as the temperature and the humidity increase, the output value of the primary transfer bias is increased as the temperature and the humidity increase as shown in Table 1.

TABLE 1

| | Humidity (%) | |
|---|---|---|
| Temperature (° C.) | HM < 70 | 70 ≦ HM |
| TP < 28 | 220 (V) | 240 (V) |
| 28 ≦ TP < 31 | 300 | 320 |
| 31 ≦ TP | 350 | 370 |

During the operations shown in FIG. 7, the CPU 111 accepts input data from the temperature sensor 6 and the humidity sensor 7 for every vertical synchronizing signal Vsync and judges whether it is necessary to change the output value of the primary transfer bias.

In FIG. 7, the vertical synchronizing signal Vsync is outputted each at the time t1, t2, t3, t4, t5, t6 and t7. The video request signal Vreq for the first image is outputted after the predetermined period T1 from the falling edge of the vertical synchronizing signal Vsync at the time t1. In synchronization to falling of this video request signal Vreq, formation of an electrostatic latent image corresponding to the video signal representing the first image is started, concurrently with which the developing bias is turned on. Meanwhile, after the predetermined period T2 from the falling edge of the vertical synchronizing signal Vsync at the time t1, the video request signal Vreq for the second image is outputted. In synchronization to falling of this video request signal Vreq, formation of an electrostatic latent image corresponding to the video signal representing the second image is started.

Since secondary transfer is not ongoing after the predetermined period T3 from the time t1, the output value from the primary transfer bias generating circuit 116 is changed to V12 from V11 in accordance with a change to the environment conditions.

As a result, a toner image K1 is primarily transferred onto the sub area 76A which is on the downstream side in the transfer area 76 of the intermediate transfer belt 31 along the direction of rotational driving 72, and a toner image K2 is primarily transferred onto the sub area 76B which is on the upstream side in the transfer area 76 of the intermediate transfer belt 31 along the direction of rotational driving 72.

Meanwhile, the transfer paper 4 is transported toward the secondary transfer part 37 from the paper feeding cassette 3 at a predetermined speed. The contacting/clearing clutch for secondary transfer roller turns on at the time t15 which is after a predetermined period from the time t1, and the secondary transfer roller 35 accordingly abuts on the intermediate transfer belt 31. Following this, at the time t16 and t17 after predetermined periods from the time t1, application of the secondary transfer bias from the secondary transfer bias generating circuit 117 upon the secondary transfer roller 35 is activated. This realizes transfer onto the first transfer paper 4 of the first toner image K1 which was primarily transferred onto the sub area 76A which is on the downstream side in the transfer area 76 of the intermediate transfer belt 31 along the direction of rotational driving 72, while realizing transfer onto the second transfer paper 4 of the second image K2 which was primarily transferred onto the sub area 76B which is on the upstream side in the transfer area 76 of the intermediate transfer belt 31 along the direction of rotational driving 72. The toner images K1 and K2 are fixed on the transfer papers 4 respectively and the transfer papers 4 are discharged.

At the time t2 which is outputting of the vertical synchronizing signal Vsync, whether it is necessary to change the output value of the primary transfer bias in accordance with the environment conditions is judged. When it is necessary to change, whether the secondary transfer bias is on after the predetermined period T3 from the time t2 is judged.

In FIG. 7, the output value needs be changed, and the secondary transfer bias is on after the predetermined period T3 from the time t2. Hence, formation of image is not performed at the time t2 but waits until the time t3 at which the vertical synchronizing signal Vsync is outputted the next time. After a predetermined period since the time t3, toner images K3 and K4 for forming the third and the fourth images are formed, and after the predetermined period T3 from the time t3, the output value of the primary transfer bias is changed to V13 from V12 and operations similar to the above are performed.

While formation of image is performed for the transfer paper 4 whose size is large, since it is possible to judge that the secondary transfer bias is on after the predetermined period T3 from the time t4 in a similar manner to the above, the output value of the primary transfer bias can not be changed. Hence, formation of image is not performed at the time t4 but waits until the time t5 at which the vertical synchronizing signal Vsync is outputted the next time.

The video request signal Vreq is outputted after the predetermined period T1 from the falling edges of the vertical synchronizing signal Vsync at t5. In synchronization to falling of this video request signal Vreq, formation of an electrostatic latent image corresponding to this video signal is started, concurrently with which the developing bias is turned on.

Since secondary transfer is not ongoing after the predetermined period T3 from the time t5, the output value from the primary transfer bias generating circuit 116 is changed to V12 from V13 in accordance with a change to the environment conditions.

Meanwhile, the transfer paper 4 is transported toward the secondary transfer part 37 from the paper feeding cassette 3 at a predetermined speed. At the time t18 after a predetermined period from the time t5, application of the secondary transfer bias from the secondary transfer bias generating circuit 117 upon the secondary transfer roller 35 is activated. This realizes transfer onto the transfer paper 4 of the toner image K5 which was primarily transferred onto the transfer area 76 of the intermediate transfer belt 31. The toner image K5 is then fixed on the transfer paper 4 and the transfer paper 4 is discharged.

At the time t6 which is outputting of the vertical synchronizing signal Vsync, whether the secondary transfer bias is on after the predetermined period T3 from the time t6 is judged. Since the secondary transfer bias is off after the predetermined period T3 from the time t6 in FIG. 7, a toner image K6 for forming the next image is formed after a predetermined period from the time t6. After the predetermined period T3 from the time t6, the output value of the primary transfer bias is changed to V11 from V12 and operations similar to the above are performed. Secondary transfer of the toner image K6 finishes, and at the time t19 which comes after turning off of the secondary transfer bias, the contacting/clearing clutch for secondary transfer roller turns on, and the secondary transfer roller 35 accordingly leaves the intermediate transfer belt 31.

As described above, during the operation shown in FIG. 7, as in the example shown in FIG. 6, since changing of the output value of the primary transfer bias completes while the transfer protection area 75 serving as the non-image area is still moving through the primary transfer part 14, it is possible to change the output value without fail prior to the start of primary transfer.

Further, as in the example shown in FIG. 6, since the primary transfer bias is changed when secondary transfer is not performed, it is possible to prevent a change to the primary transfer bias from adversely affecting secondary transfer, and hence, the quality of an image transferred onto the transfer paper 4 from deteriorating.

While an unnecessary toner image will be formed in the configuration that formation of image is continued at the time of detection of the vertical synchronizing signal Vsync and therefore the output value of the primary transfer bias can not be changed although necessary because of the ongoing secondary transfer, during the operations shown in FIG. 7, since whether it is necessary to change the output value of the primary transfer bias in accordance with the bias change conditions is judged when the vertical synchronizing signal Vsync is detected, it is possible to prevent from forming an unnecessary toner image.

Figure 8:
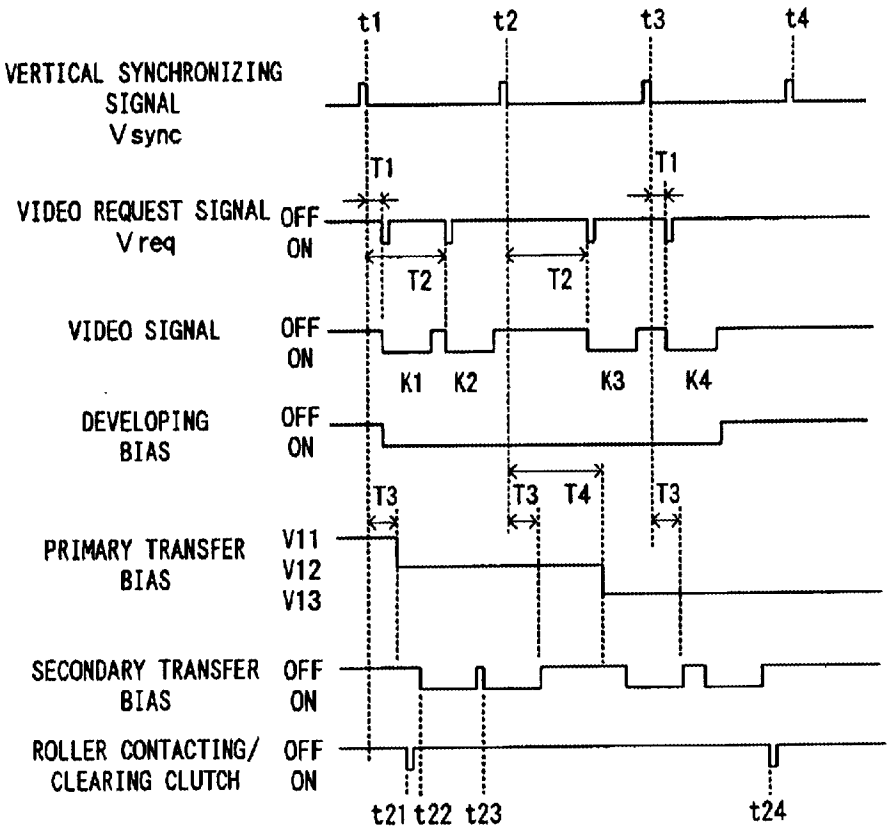
FIG. 8 is a timing chart for describing still other operations, which shows time-induced changes appearing in the conditions of the respective portions of the engine part.

Referring to FIG. 8, still other operations of th is printer will now be described. FIG. 8 is a timing chart which shows time-induced changes appearing in the conditions of the respective portions of the engine part 1. The illustrate example is a situation that four monochrome images of such a size that can be transferred two images during one rotation of the intermediate transfer belt 31 are to be formed. The same symbols as those used in FIG. 6 denote the same timing. For convenience of illustration, FIG. 8 shows as if the video signal turns on in synchronization to the video request signal Vreq as in FIG. 6.

As in FIG. 7, the primary transfer bias is changed in accordance with the environment conditions representing the temperature and the humidity level in FIG. 8. In addition, since a monochrome image (in K for instance) is formed in FIG. 8 as in FIG. 7, the black developer unit 2K remains serving as the rotary developer 20. Hence, the developing bias stays turned on until an image has been formed. Since superimposition of toner images is not performed, until an image has been formed, the secondary transfer roller 35 is maintained abutting on the intermediate transfer belt 31. Further, the values shown in Table 1 described earlier are used as the output value of the primary transfer bias which is in accordance with the temperature and the humidity.

In FIG. 8, the vertical synchronizing signal Vsync is outputted each at the time t1, t2, t3 and t4. The video request signal Vreq for the first image is outputted after the predetermined period T1 from the falling edge of the vertical synchronizing signal Vsync at the time t1. In synchronization to falling of this video request signal Vreq, formation of an electrostatic latent image corresponding to the video signal representing the first image is started, concurrently with which the developing bias is turned on. Meanwhile, after the predetermined period T2 from the falling edge of the vertical synchronizing signal Vsync at the time t1, the video request signal Vreq for the second image is outputted. In synchronization to falling of this video request signal Vreq, formation of an electrostatic latent image corresponding to the video signal representing the second image is started.

Since secondary transfer is not ongoing after the predetermined period T3 from the time t1, the output value from the primary transfer bias generating circuit 116 is changed to V12 from V11 in accordance with a change to the environment conditions.

As a result, a toner image K1 is primarily transferred onto the sub area 76A which is on the downstream side in transfer area 76 of the intermediate transfer belt 31 along the direction of rotational driving 72, and a toner image K2 is primarily transferred onto the sub area 76B which is on the upstream side in the transfer area 76 of the intermediate transfer belt 31 along the direction of rotational driving 72.

Meanwhile, the transfer paper 4 is transported toward the secondary transfer part 37 from the paper feeding cassette 3 at a predetermined speed. At the time t21 after a predetermined period from the time t1, the contacting/clearing clutch for secondary transfer roller turns on, and the secondary transfer roller 35 accordingly abuts on the intermediate transfer belt 31. At the time t22 and t23 after predetermined periods from the time t1, application of the secondary transfer bias from the secondary transfer bias generating circuit 117 upon the secondary transfer roller 35 is activated. This realizes transfer onto the first transfer paper 4 of the toner image K1 which was primarily transferred onto the sub area 76A which is on the downstream side in transfer area 76 of the intermediate transfer belt 31 along the direction of rotational driving 72, while realizing transfer onto the second transfer paper 4 of the second image K2 which was primarily transferred onto the sub area 76B which is on the upstream side in the transfer area 76 of the intermediate transfer belt 31 along the direction of rotational driving 72. The toner images K1 and K2 are fixed on the transfer papers 4 respectively and the transfer papers 4 are discharged.

At the time t2 at which the vertical synchronizing signal Vsync is outputted the next time, based on the period during which the secondary transfer bias is applied is determined in advance in accordance with the size of the transfer papers 4, whether the secondary transfer bias is on after the predetermined period T3 from the time t2 is judged. Since the secondary transfer bias is on after the predetermined period T3 from the time t2 in FIG. 8, an image is not formed at the time t2 but the printer stays on stand-by. After the predetermined period T2 from the time t2, whether the secondary transfer bias is on is judged.

Since the secondary transfer bias is off after the predetermined period T2 from the time t2 in FIG. 8, for the purpose of primary transfer onto the sub area 76B which is on the upstream side in the transfer area 76 along the direction of rotational driving 72, the video request signal Vreq is outputted after the predetermined period T2 has elapsed since the time t2. In synchronization to falling of this video request signal Vreq, formation of an electrostatic latent image corresponding to the video signal representing the third image is started and a toner image K3 is formed. After a predetermined period T4 from the time t2, the output value of the primary transfer bias is changed to V13 from V12 and primary transfer of the toner image K3 is performed, followed by secondary transfer.

The predetermined period T4 is determined in advance such that changing of the primary transfer bias to be applied upon the intermediate transfer belt 31 will have completed before the front edge of a toner image on the photosensitive member 11 which was formed to match in terms of timing with the sub area 76B of the intermediate transfer belt 31 (the downstream edge along the direction of rotational driving 72) reaches the primary transfer part 14 (i.e., while the sub area 76A not bearing a transferred toner image and serving as the non-image area is moving through the primary transfer part 14).

At the time t3 at which the vertical synchronizing signal Vsync is outputted the next time, whether there is a change to the environment conditions and it is necessary to change the output value of the primary transfer bias is judged, and it is judged that it is not necessary to change the output value in this example. The video request signal Vreq for the fourth image is outputted after the predetermined period T1 from the time t3, and a toner image K4 is accordingly formed. Although secondary transfer is ongoing after the predetermined period T3 from the time t3, since there is no change to the environment conditions and the output value of the primary transfer bias is not changed, the operation of forming an image is performed. Although the output value is not changed as described above, the same data as the previous data are fed to the D/A convertor 121 from the CPU 111 as control data after the predetermined period T3 from the time t3.

Secondary transfer of the toner image K4 finishes, and at the time t24 which comes after turning off of the secondary transfer bias, the contacting/clearing clutch for secondary transfer roller turns on, and the secondary transfer roller 35 accordingly leaves the intermediate transfer belt 31.

As described above, during the operations shown in FIG. 8, as in the example shown in FIG. 6, since the output value of the primary transfer bias is changed when secondary transfer is not ongoing, it is possible to prevent a change to the primary transfer bias from adversely affecting secondary transfer, and hence, the quality of an image transferred onto the transfer paper 4 from deteriorating.

Further, during the operations shown in FIG. 8, the printer waits only for the sub area 76A, which does not bear a toner image and which serves as the non-image area, to move passed instead of remaining on stand-by until the next vertical synchronizing signal Vsync. Hence, the throughput improves for this amount than in the operations shown in FIG. 7.

In addition, during the operations shown in FIG. 8, whether it is necessary to change the output value of the primary transfer bias in accordance with the bias change conditions is judged when the vertical synchronizing signal Vsync is detected. Therefore, when there is no change to the environment conditions and the output value of the primary transfer bias needs not be changed, it is possible to continue forming an image and prevent a deterioration in throughput.

Although the preferred embodiment above uses the intermediate transfer belt 31 which is formed by an endless belt joined at the splice 71, the intermediate transfer medium used in the present invention is not limited to this. Instead, the intermediate transfer medium may be an intermediate transfer belt which is formed by a seamless endless belt having no splice, an intermediate transfer drum having a cylindrical shape, or the like for instance, in which case the transfer protection area 75 may be provided as an area in which the belt cleaner 33 abuts on and leaves the intermediate transfer belt 31.

Further, although the output value of the primary transfer bias is changed in all of the first through the fourth rounds of primary transfer during the operations according to the preferred embodiment above shown in FIG. 6, this is not limiting. The output value may be the same value from the first through the third rounds of primary transfer and the output value of the primary transfer bias for the fourth round of primary transfer alone may be changed, for example. Alternatively, the output value of the primary transfer bias for the first round of primary transfer alone may be changed while the same value may be used for the second through the fourth rounds of primary transfer.

While the preferred embodiment above is directed to a color printer, the operations shown in FIGS. 7 and 8 are not limited to this but may be applicable to a monochrome printer as well. Further, the foregoing has described the preferred embodiment above in relation to a color printer which comprises one photosensitive member and requires to continuously rotate the intermediate transfer belt 31 for superimposition of toner images, the operations shown in FIG. 8 are not limited to this but may be applicable to a color printer of the so-called tandem type which comprises a plurality of photosensitive members which are aligned along an intermediate transfer belt.

Figure 9:
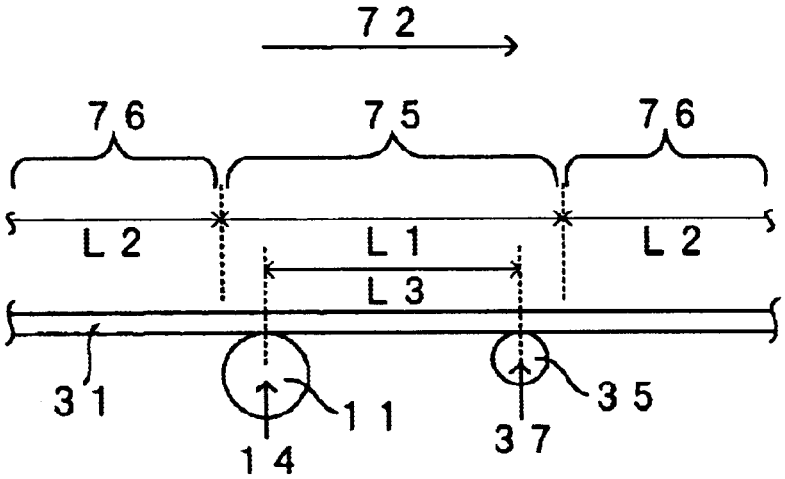
FIG. 9 is a drawing of a modification.

Alternatively, an embodiment as that shown in FIG. 9 may be used. The following relationship holds in the embodiment shown in FIG. 9:

$$L1>L3$$

where L0 is the total length of the intermediate transfer belt 31 (FIGS. 4A and 4B), L1 is the size of the transfer protection area 75 along the direction of rotational driving 72 as shown in FIG. 9, L2 is the size of the transfer area 76 (L0=L1+L2), and L3 is a distance between the primary transfer part 14 and the secondary transfer part 37.

The CPU 111 performs the control for changing the output value of the primary transfer bias, while the transfer protection area 75 is passing through both the primary transfer part 14 and the secondary transfer part 37. In this modified embodiment, it is possible to prevent the output value of the primary transfer bias from getting changed without fail during secondary transfer. This allows the configuration for controlling to be simple.

<Second Preferred Embodiment>

A second preferred embodiment of the image forming apparatus according to the present invention will now be described. A major difference in structure of the second preferred embodiment from the first preferred embodiment is that the intermediate transfer belt 31 is formed by an endless belt having no splice (seamless). In the second preferred embodiment, a transfer area 79 of the intermediate transfer belt 31 has a larger size than the size of an A3 paper as it is placed with the longer sides aligned along the direction of rotational driving 72 for example. It is possible to split the transfer area 79 into two sub areas 79A and 79B, so as to transfer during one rotation of the intermediate transfer belt 31 two toner images 78 having the A4 size with the shorter sides aligned along the direction of rotational driving 72. The other structures are the same, and therefore, will not be described yet denoted at the same reference symbols.

The CPU 111 changes the output value of the primary transfer bias to the D/A convertor 121 as in the first preferred embodiment, and the output value is changed when secondary transfer is not ongoing according to the second preferred embodiment. When a plurality of images are to be formed in a row for instance, the output value of the primary transfer bias for the fourth color (which is K for example in FIG. 11 which will be described later) used to form a previous image is changed to the output value of the primary transfer bias for the first color (which is Y for example in FIG. 11) used to form the next image, after completion of secondary transfer which is for formation of the previous image.

At this stage, the CPU 111 judges the completion timing of secondary transfer onto the transfer paper 4 based on the size of the transfer paper 4, and starts the operation of forming an image on the photosensitive member 11 during execution of secondary transfer so that the next toner image in the first color on the photosensitive member 11 will arrive at the primary transfer part 14 immediately after thus judged completion timing.

The intermediate transfer belt 31 corresponds to the intermediate transfer medium, while the bias applying member 31A and the primary transfer bias generating circuit 116 correspond to the primary transfer means, and the secondary transfer roller 35 and the secondary transfer bias generating circuit 117 correspond to secondary transfer means. Meanwhile, the CPU 111 corresponds to the bias control means, completion judging means and image formation control means.

Figure 11:
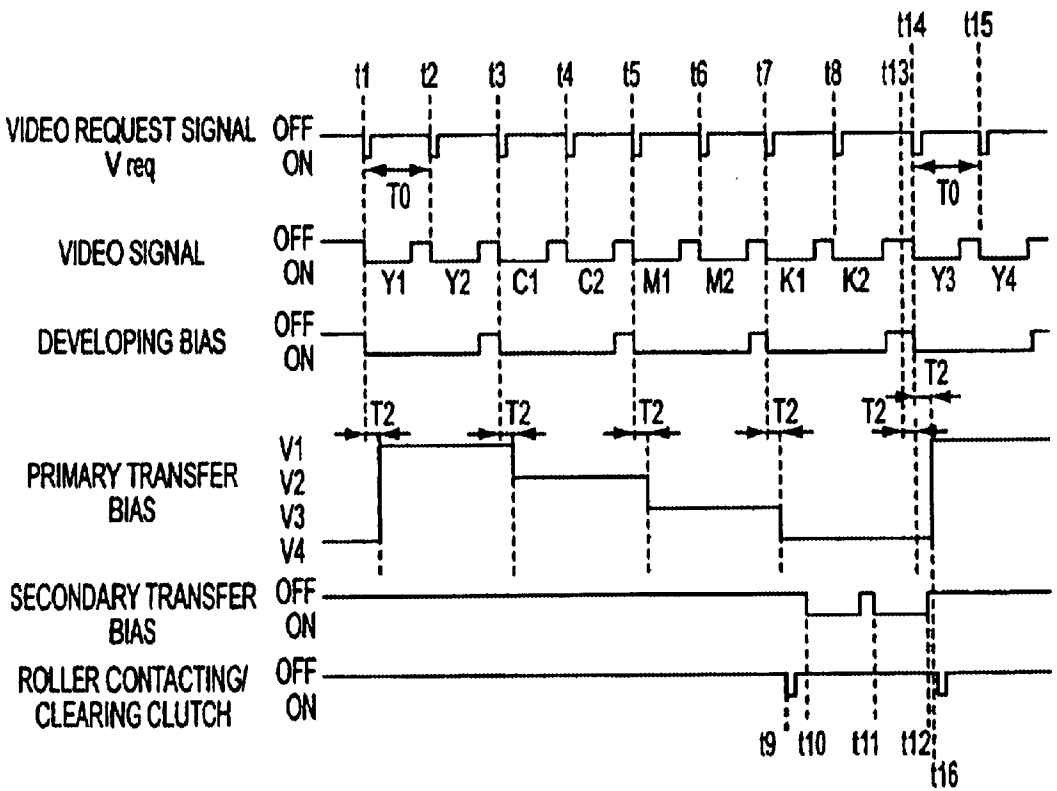
FIG. 11 is a timing chart for describing operations, which shows time-induced changes appearing in the conditions of the respective portions of an engine part.

Referring to FIG. 11, an operation of this printer will now be described. FIG. 11 is a timing chart which shows time-induced changes appearing in the conditions of the respective portions of the engine part 1. The illustrate example is a situation that four color images of such a size that can be transferred two images during one rotation of the intermediate transfer belt 31 (the A4 size for example) are formed and that the output value of the primary transfer bias is changed for every primary transfer of a toner image which will be superimposed. The video signal and the developing bias are turned on at predetermined timing in response to the video request signal Vreq, and therefore, this timing is in a predetermined delay from the timing of the video request signal Vreq. However, for convenience of illustration, FIG. 11 shows as if these are turned on in synchronization to the video request signal Vreq.

As the print instruction signal containing the video signal is fed to the main controller 100 from the external apparatus such as a host computer, in response to the control signal received from the main controller 100, the engine controller 110 starts operating the respective portions of the engine part 1. At this stage, if the size of the transfer papers 4 stacked up in the paper feeding cassette 3 fails to match with the size designated by the print instruction signal, an operation display panel 8 shows a message which encourages to replace the paper feeding cassette.

When the size of the transfer papers 4 stacked up in the paper feeding cassette 3 matches with the size designated by the print instruction signal (i.e., when a plurality of paper feeding cassettes include a cassette which holds the transfer papers 4 of the size designated by the print instruction signal), by means of the laser light 57 emitted from the exposure unit 50, an electrostatic latent image corresponding to the video signal described above is created on the surface of the photosensitive member 11 which is uniformly electrified by the electrifier 12. The rotary developer 20 develops the electrostatic latent image, thereby forming a toner image. In the primary transfer part 14, the toner image thus formed on the photosensitive member 11 is primarily transferred onto the intermediate transfer belt 31.

Figure 10:
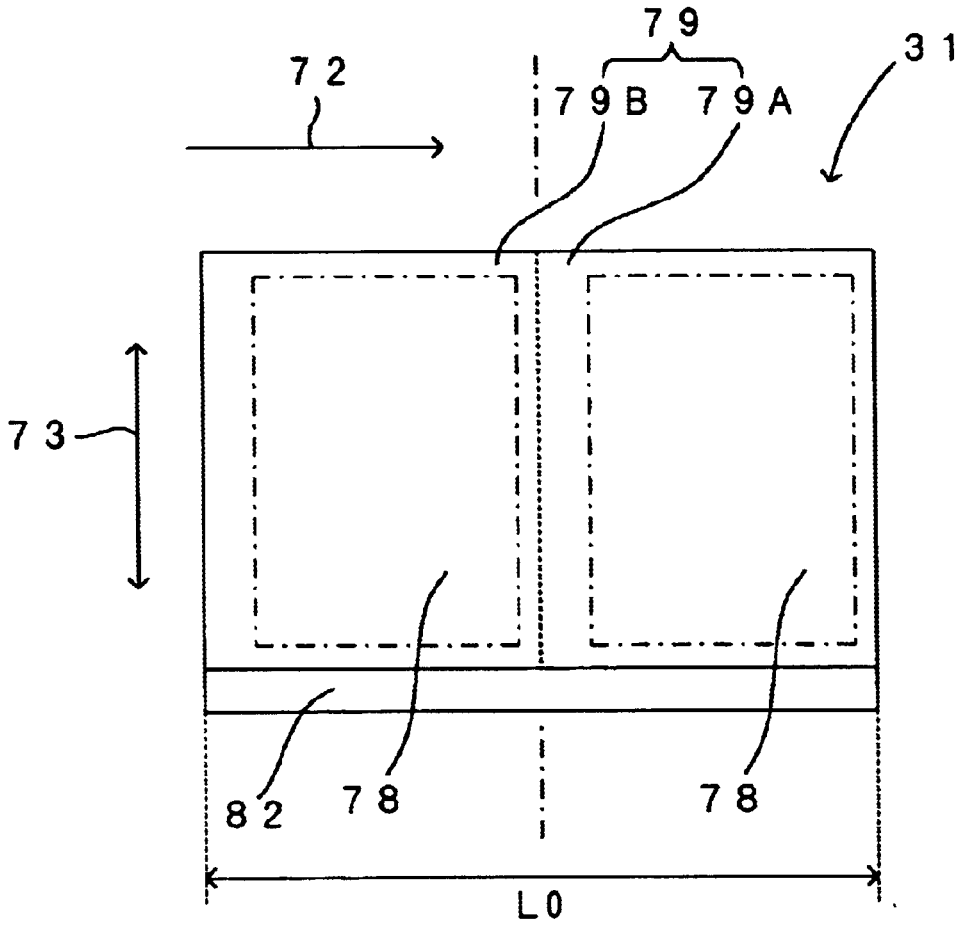
FIG. 10 is a development view of an intermediate transfer belt.

That is, the photosensitive member driving motor 36 rotates the intermediate transfer belt 31 at a predetermined peripheral velocity, and the video request signal Vreq is outputted each at the time t1, t2, t3, t4, t5, t6, t7 and t8 as shown in FIG. 11. In FIG. 11, the following holds:

$$L0=2\cdot T_0\cdot S1$$

where $T_0$ denotes the cycle of outputting the video request signal Vreq and S1 denotes the peripheral velocity of the intermediate transfer belt 31. As shown in FIG. 10, two toner images having the A4 size are transferred as the intermediate transfer belt 31 rotates one round.

Formation of an electrostatic latent image corresponding to the video signal representing the first image is started in response to receipt of the video request signal Vreq at the time t1, and the developing bias is turned on. Following this, in response to receipt of the video request signal Vreq at the time t2, formation of an electrostatic latent image corresponding to the video signal representing the second image is started.

The developer units of the rotary developer 20 switch over with each other at the time t1, t3, t5 and t7, whereby toner images in the respective colors are formed on the photosensitive member 11 and primarily transferred one after another onto the intermediate transfer belt 31. At this stage, after the predetermined period T2 from the time t1, t3, t5 and t7, the output value from the primary transfer bias generating circuit 116 is changed.

In this embodiment, the primary transfer bias for the first image (Y) is set to a voltage V1 (V1=220 V for example), the primary transfer bias for the second image (C) is set to a voltage V2 (V2=245 V for example), the primary transfer bias for the third image (M) is set to a voltage V3 (V3=270 V for example), and the primary transfer bias for the fourth image (K) is set to a voltage V4 (V4=300 V for example).

The predetermined period T2 is set in advance such that changing of the primary transfer bias to be applied to the intermediate transfer belt 31 will have completed before the front edge of a toner image on the photosensitive member 11 (the downstream edge along the direction of rotational driving 72) reaches the primary transfer part 14.

Since primary transfer is not complete yet after the predetermined period T2 from the time t1, t3, t5 and t7, secondary transfer is not performed. Hence, even if the output value of the primary transfer bias is changed, there will be no problem. In short, since the secondary transfer roller 35 stays cleared off from the intermediate transfer belt 31 during this, the toner images in the respective colors are superimposed one atop the other on the intermediate transfer belt 31.

The developing bias is turned off after a predetermined period of time which is determined in advance depending on the size of the transfer papers since the falling edges of the video request signal Vreq at the time t1, t3, t5 and t7.

As a result, a color image which is toner images Y1, C1, M1 and K1 as they are superimposed one atop the other is primarily transferred onto the sub area 79A which is on the downstream side in the transfer area 79 of the intermediate transfer belt 31 along the direction of rotational driving 72, and a color image which is toner images Y2, C2, M2 and K2 as they are superimposed one atop the other is primarily transferred onto the sub area 79B which is on the upstream side in the transfer area 79 of the intermediate transfer belt 31 along the direction of rotational driving 72.

On the other hand, the top-most transfer paper 4 among the bundle of transfer papers housed in the paper feeding cassette 3 is taken out by the pick-up roller 61, transported by the feed roller pair 62 at the predetermined speed S1, and nipped by the gate roller pair 34. The gate clutch turns on in synchronization to a toner image on the intermediate transfer belt 31, and the transfer paper 4 is transported toward the secondary transfer part 37 from the gate roller pair 34 at the predetermined speed S1.

The contacting/clearing clutch for secondary transfer roller turns on at the time t9 which is after a predetermined period since the time t7, and the secondary transfer roller 35 accordingly abuts on the intermediate transfer belt 31. Following this, at the time t10 which is after a predetermined period from the time t7, application of the secondary transfer bias from the secondary transfer bias generating circuit 117 upon the secondary transfer roller 35 is activated.

This realizes transfer onto the first transfer paper 4 of the color image which is toner images Y1, C1, M1 and K1 as they are superimposed one atop the other and which was primarily transferred onto the sub area 79A which is on the downstream side in the transfer area 79 of the intermediate transfer belt 31 along the direction of rotational driving 72.

The gate clutch is temporarily turned off after discharging of the first transfer paper 4. A period during which the secondary transfer bias is applied is set in advance in accordance with the size of the transfer papers 4. At this stage, the next transfer paper 4 is taken out by the pick-up roller 61, transported by the feed roller pair 62 at the predetermined speed S1, and nipped by the gate roller pair 34.

After turning off of the gate clutch and inactivation of application of the secondary transfer bias, the gate clutch turns on in synchronization to the next toner image and the next transfer paper 4 is transported, and application of the secondary transfer bias turns on at the time till which is after a predetermined period from the time t7. When the preset period during which the secondary transfer bias is applied elapses (the time t12), application of the secondary transfer bias turns off, and after a predetermined period from the time t7, the contacting/clearing clutch for secondary transfer roller turns on and the secondary transfer roller 35 leaves the intermediate transfer belt 31.

This realizes transfer onto the second transfer paper 4 of the color image which is toner images Y2, C2, M2 and K2 as they are superimposed one atop the other and which was primarily transferred onto the sub area 79B which is on the upstream side in the transfer area 79 of the intermediate transfer belt 31 along the direction of rotational driving 72.

In the fixing unit 40, this toner image is fixed on the transfer paper 4 during transportation of the transfer paper 4. The transfer paper 4 is further transported by the transportation roller pair 63 and discharged by the discharge roller pair 64 into a discharging part 9 which is disposed to an upper section of the main unit 2.

While the third and the fourth images are formed on the photosensitive member 11 following this, since the period during which the secondary transfer bias is applied is determined in advance in accordance with the size of the transfer papers 4, after the predetermined cycle T1 from the time t8 (i.e., at the time t13), it is already possible to determine whether the secondary transfer bias is on further after the predetermined period T2 (i.e., whether t13+T2 comes earlier than the time t12). In FIG. 11, since the secondary transfer bias is on after the predetermined period T2 from the time t13 and the CPU 111 learns of this upon judgement at the time t13, the video request signal Vreq is not outputted at the time t13 and the printer remains on stand-by for a predetermined standby period.

In the predetermined cycle T1, the video request signal Vreq is outputted at the time t14, t15, . . . whereby toner images Y3 and Y4 which are to form the third and the fourth images are formed. At the time t16 after the predetermined period T2 from the time t14, the output value of the primary transfer bias is changed to V1 and operations similar to the above are performed. The time t14 is set such that the secondary transfer bias is off again at the time t16 which is after the predetermined period T2 from the time t14 (such that the time t16 comes later than the time t12).

Since formation of the third and the fourth images at and after the time t14 is in a delay equivalent to the stand-by period as compared to formation of the first and the second images, the time at which the belt cleaner 33 abuts on the intermediate transfer belt 31 and the time at which the belt cleaner 33 leaves the intermediate transfer belt 31 may be changed considering the delay.

As described above, during the operation shown in FIG. 11, since the output value of the primary transfer bias is changed for every primary transfer of a toner image, it is possible to primarily transfer the toner in the respective colors onto the intermediate transfer belt 31 in an excellent manner in accordance with the toner transfer efficiency which changes depending on the thickness of the stacked-up toner on the intermediate transfer belt 31, and hence, to obtain a color image having a high image quality on the transfer paper 4.

Further, since the output value of the primary transfer bias is changed when secondary transfer is not ongoing (after completion of secondary transfer), it is possible to prevent a change to the primary transfer bias from adversely affecting secondary transfer, and hence, the quality of an image transferred onto the transfer paper 4 from deteriorating.

In addition, since the time t14 for resuming outputting of the video request signal Vreq is set such that the secondary transfer bias is already off again at the time t16 which is after the predetermined period T2 from the time t16 (such that the time t16 comes later than the time t12), it is possible to increase or decrease the stand-by period in accordance with the size of the transfer papers 4, and hence, to suppress a deterioration in throughput as much as possible.

For instance, although the preferred embodiment above uses an endless belt having no splice as the intermediate transfer belt 31, the intermediate transfer medium used in the present invention is not limited to this. Instead, an intermediate transfer drum having a cylindrical shape may be used for instance.

Further, although the preferred embodiment above requires to change the output value of the primary transfer bias during primary transfer of each one of toner images in the first through the fourth colors, this is not limiting. For example, the same output value may be used for primary transfer of the first through the third toner images, and the output value may be changed for primary transfer of only the fourth toner image. Alternatively, the output value may be changed for primary transfer of only the first toner image and the same output value may be used for primary transfer of the second through the fourth toner images. In short, the only requirement is to change the output value between primary transfer of the first toner image and primary transfer of the last toner image.

Still further, the time t14 for resuming outputting of the video request signal Vreq is set such that the secondary transfer bias is already off again at the time t16 which is after the predetermined period T2 from the time t14 (such that the time t16 comes later than the time t12) according to the preferred embodiment above, this is not limiting. Instead, outputting of the video request signal Vreq may be resumed in synchronization to the time t12 at which the secondary transfer bias turns off again. Such simplifies the control sequence and makes it easy to design the control program.

<Third Preferred Embodiment>

A third preferred embodiment of the image forming apparatus according to the present invention will now be described. A major difference in structure of the third preferred embodiment from the first preferred embodiment is that a tandem-type structure is used. The major difference will be mainly described in the following, and the same structures will not be described yet denoted at the same reference symbols.

Figure 12:
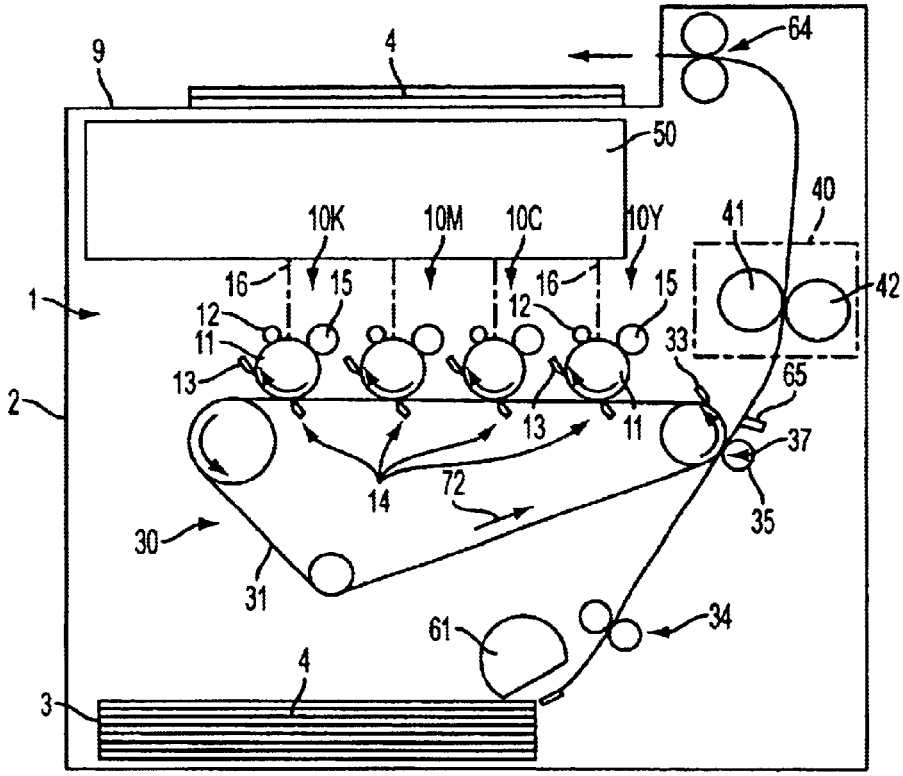
FIG. 12 is a drawing which shows an inner structure of a printer which is a preferred embodiment of an image forming apparatus according to the present invention.

The engine part 1 comprises the exposure unit 50, photosensitive member units 10Y, 10C, 10M and 10K, an intermediate transfer unit 30 and the fixing unit 40 as shown in FIG. 12. The exposure unit 50 comprises a laser light source, a horizontal synchronization sensor, etc. Each one of the photosensitive member units 10Y, 10C, 10M and 10K comprises a photosensitive member 11, an electrifier 12, a developer 15 and a cleaner 13. The intermediate transfer unit 30 comprises the intermediate transfer belt 31, the bias applying member 31A, the belt cleaner 33, the secondary transfer roller 35, the photosensitive member driving motor 36, etc. The developers 15 of the photosensitive member units 10Y, 10C, 10M and 10K house yellow toner, cyan toner, magenta toner and black toner, respectively. The photosensitive members 11 of the photosensitive member units 10Y, 10C, 10M and 10K are arranged one next to the other along the intermediate transfer belt 31.

This printer uses a structure of the so-called tandem type that toner images in the respective colors are formed on the photosensitive members 11 of the photosensitive member units 10Y, 10C, 10M and 10K, the toner images on the photosensitive members 11 are primarily transferred onto the intermediate transfer belt 31 so that the toner images will be superimposed one atop the other, and thus primarily transferred toner image is secondarily transferred onto the transfer paper 4 in the secondary transfer part 37. In this printer, the output values of the primary transfer biases are changed in accordance with results of a temperature sensor 6 and a humidity sensor 7, and as described later, the output value is changed after the transported transfer paper 4 is discharged from the secondary transfer part 37 but before the next transfer paper 4 is loaded into the secondary transfer part 37.

The exposure unit 50 comprises a laser light source which is formed by a semiconductor laser for instance, a polygon mirror which reflects laser light from the laser light source, a scanner motor which drives the polygon mirror so that the polygon mirror rotates at a high speed, a lens part which converges the laser light reflected by the polygon mirror, the horizontal synchronization sensor 56 and the like as one set, and four such sets respectively for the photosensitive member units 10Y, 10C, 10M and 10K. Laser light 16 reflected by the polygon mirror and emitted through the lens part scans the surfaces of the photosensitive members 11 in the main scanning direction (a direction which is perpendicular to the plane of FIG. 12), whereby electrostatic latent images corresponding to video signals are formed on the surfaces of the photosensitive members 11. At this stage, the horizontal synchronization sensors 56 provide synchronizing signals which are in the main scanning direction, i.e., horizontal synchronizing signals. The exposure unit 50 functions as exposure means.

The photosensitive member units 10Y, 10C, 10M and 10K have the same structure, and the respective photosensitive members 11 is rotated by the photosensitive member driving motor 36 in the direction denoted at arrows. The electrifiers 12, the developers 15 and the cleaners 13 are arranged around the respective photosensitive members 11 along the rotating direction of the photosensitive members 11. For convenience of illustration, FIG. 12 omits reference symbols denoting the respective portions of the photosensitive member units 10C and 10M.

The electrifiers 12 comprise wire electrodes to which a high voltage at a predetermined level is applied. Utilizing corona discharge for instance, the electrifiers 12 uniformly electrify outer circumferential surfaces of the photosensitive members 11. The developers 15 make toner of the respective colors adhere to electrostatic latent images formed by the exposure unit 50 to thereby form toner images. As developing biases, which are direct current components as they are alone or direct current components on which alternating current components are superimposed, are applied, the toner in the respective colors from the developers 15 adhere to the surfaces of the photosensitive members 11. The cleaners 13 are disposed immediately on the upstream side to the electrifiers 12 in the rotating direction of the photosensitive members 11, and scrape off the toner remaining on the outer circumferential surfaces of the photosensitive members 11 to thereby clean the surfaces of the photosensitive members 11 after primary transfer of a toner image onto the intermediate transfer belt 31 from the photosensitive members 11. The developers 15 function as developing means.

Figure 13:
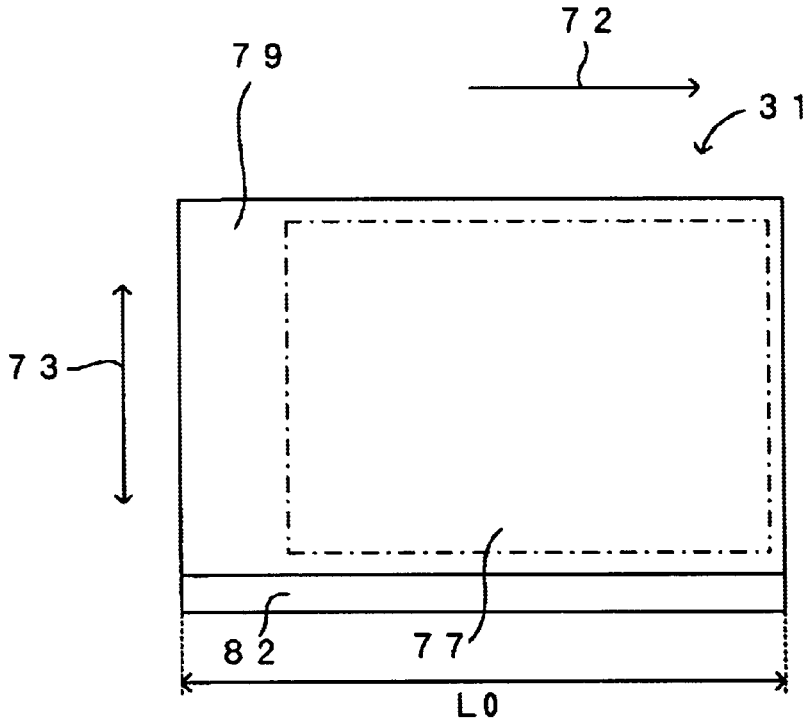
FIG. 13 is a development view of an intermediate transfer belt.

The intermediate transfer belt 31 is formed by an endless belt having no splice (seamless), and as shown in the development view in FIG. 13, has the total length of L0. In FIG. 13, an arrow 72 denotes the direction of rotational driving while an arrow 73 denotes the direction of rotation axis. The transfer area 79 of the intermediate transfer belt 31 has a larger size than the size of an A3 paper as it is placed with the longer sides aligned along the direction of rotational driving 72 for example.

The belt cleaner 33 is disposed abutting on a portion where the intermediate transfer belt 31 is wound around a drive roller, the portion being the downstream side to the secondary transfer part 37 along the direction of rotational driving. The belt cleaner 33 scrapes off toner which remains on the outer circumferential surface of the intermediate transfer belt 31 after secondary transfer.

The crescent-shaped pick-up roller 61 and the gate roller pair 34 are disposed toward above from the front edge of the paper feeding cassette 3 (the right-most edge in FIG. 12), and a discharge roller pair 64 is disposed on the opposite side to the secondary transfer roller 35 and the fixing unit 40, whereby a transportation path for the transfer papers 4 is formed. On the transportation path and immediately on the downstream side to the secondary transfer part 37 along the transfer paper transporting direction, there is a post-transfer paper sensor 65.

The pick-up roller 61 is driven by a pick-up solenoid. The gate roller pair 34, the secondary transfer roller 35, the heating roller 41 of the fixing unit 40 and the discharge roller pair 64 are each linked to the same transportation system driving motor 60 via a drive force transmission mechanism. The transportation system driving motor 60 transports the transfer paper 4 at the predetermined speed S1. When a gate clutch is turned on, the drive force of a transportation system driving motor 60 is transmitted to the gate roller pair 34 so that the gate roller pair 34 accordingly rotates. The post-transfer paper sensor 65 is formed by an actuation piece which is revolved by the moving transfer paper 4 for instance and a photo-interrupter which detects revolutions of the actuation piece, and detects a passage of the transfer paper 4. Discharged by the discharge roller pair 64, the transfer papers 4 are stacked up in a discharging part 9 which is disposed to an upper section of the main unit 2. The gate roller pair 34 and the discharge roller pair 64 constitute transporting means for the transfer papers 4.

The CPU 111 receives atmosphere temperature data from the temperature sensor 6 as input signals from the engine part 1, atmosphere humidity data from the humidity sensor 7, the horizontal synchronizing signal Hsync from the horizontal synchronization sensor 56, and a detection signal regarding whether the transfer paper 4 has passed from the post-transfer paper sensor 65. Based on these input signals and the control program, the CPU 111 controls operations of the respective portions of the engine part 1.

In other words, the CPU 111 sends a control signal to the motor drive circuit 114 which drives the photosensitive member driving motor 36, synchronizes the photosensitive members 11 and the intermediate transfer belt 31 to each other, and drives these. Further, the CPU 111 sends a control signal to the motor drive circuit 115 which drives the transportation system driving motor 60, and controls feeding of the transfer paper 4 from the paper feeding cassette 3. The CPU 111 sends a control signal also to the gate clutch and controls the timing of transporting the transfer papers 4 toward the secondary transfer part 37. The CPU 111 also controls the operations of the respective photosensitive members 11 to form images, such that primary transfer toner images primarily transferred onto the intermediate transfer belt 31 from the respective photosensitive members 11 will be superimposed one atop the other on the intermediate transfer belt 31.

Further, the CPU 111 sends a control signal to the primary transfer bias generating circuit 116 which generates the primary transfer bias, to thereby control application of the primary transfer bias upon the intermediate transfer belt 31. The CPU 111 sends a control signal also to the secondary transfer bias generating circuit 117 which generates the secondary transfer bias, to thereby control application of the secondary transfer bias upon the secondary transfer roller 35.

The CPU 111 changes the output value of the primary transfer bias to the D/A convertor 121 in accordance with a predetermined bias change condition. Used as the predetermined bias change condition is an environment condition regarding the temperature of an atmosphere detected by the temperature sensor 6 and the humidity level of the atmosphere detected by the humidity sensor 7. In this case, as described later, the CPU 111 accepts input data from the temperature sensor 6 and the humidity sensor 7 at predetermined timing, and judges whether it is necessary to change the output values of the primary transfer biases.

The CPU 111 judges whether the transfer paper 4 has been loaded into the secondary transfer part 37, and when the transfer paper 4 has not been loaded into the secondary transfer part 37 yet, the CPU 111 changes the output values of the primary transfer biases. However, the CPU 111 changes the output values when primary transfer is not ongoing.

The timing of loading of the transfer paper 4 into the secondary transfer part 37 is determined based on the elapsed time from turning on of the gate clutch which drives the gate roller pair 34. Since a distance from the gate roller pair 34 to the secondary transfer part 37 and the transportation speed for the transfer papers 4 are known, a period of time needed for the transfer paper 4 to enter the secondary transfer part 37 since turning on of the gate clutch is also known. Meanwhile, the timing of departure of the transfer paper 4 from the secondary transfer part 37 is determined from a passage of the rear edge of the transfer paper 4 and switching of the post-transfer paper sensor 65 from on to off.

One example of the output values of the primary transfer biases in accordance with the environment condition regarding the temperature of an atmosphere and the humidity level of the atmosphere is as shown in Table 1.

Even when it is not necessary to change the output values of the primary transfer biases in accordance with the bias change condition, the CPU 111 sends control data to the D/A convertor 121 of the primary transfer bias generating circuit 116. Hence, even if a noise for example creates a garbage content in the control data fed to the D/A convertor 121, it is possible to prevent the primary transfer bias generating circuit 116 from continuously operating using such abnormal data.

The intermediate transfer belt 31 corresponds to the intermediate transfer medium, while the bias applying member 31A and the primary transfer bias generating circuit 116 correspond to the primary transfer means, and the secondary transfer roller 35 and the secondary transfer bias generating circuit 117 correspond to secondary transfer means. The CPU 111 corresponds to the bias control means, transfer paper judging means, image formation control means and bias change judging means.

Figure 14:
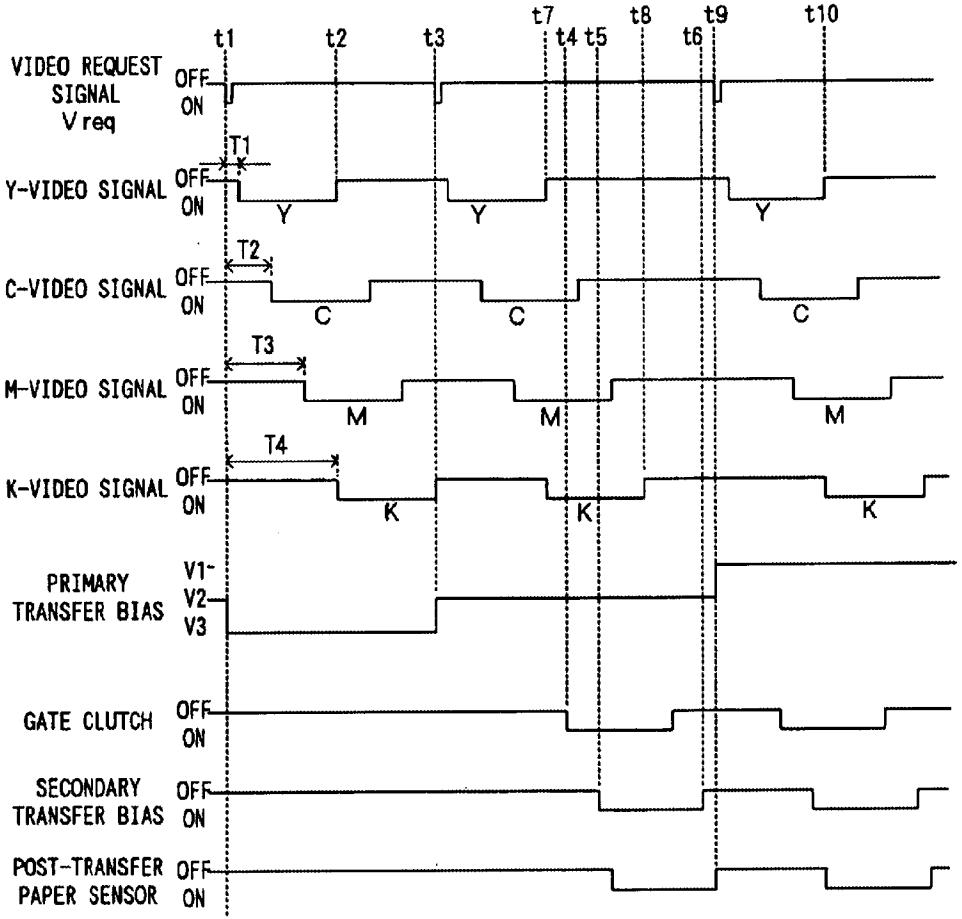
FIG. 14 is a timing chart for describing operations, which shows time-induced changes appearing in the conditions of the respective portions of an engine part.
Figure 15:
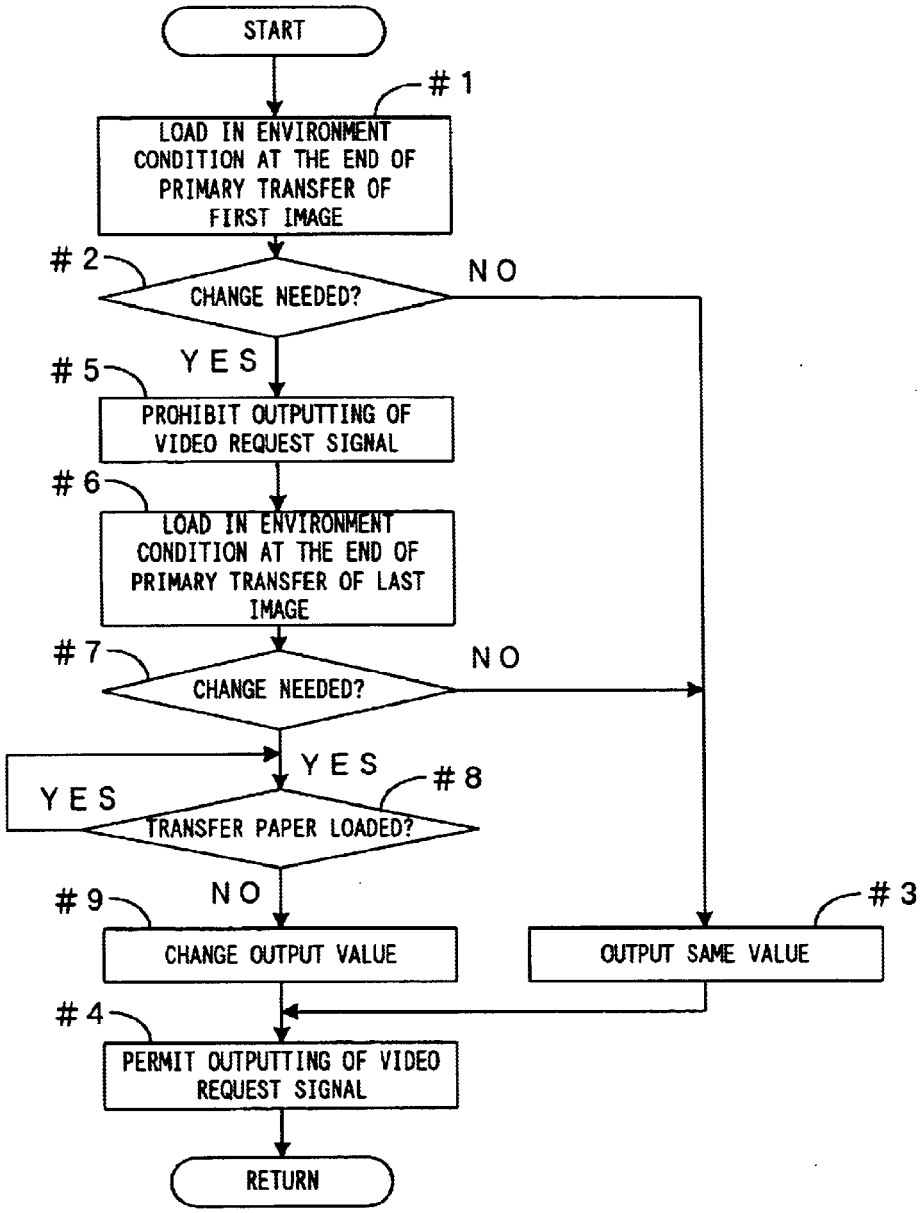
FIG. 15 is a flow chart which shows one example of the sequence of changing an output value of a primary transfer bias.

An example of operations of the printer will now be described with reference to FIGS. 14 and 15. FIG. 14 is a timing chart which shows time-induced changes appearing in the conditions of the respective portions of the engine part 1. FIG. 15 is a flow chart which shows an example of the sequence of changing the output value of the primary transfer bias.

When a print instruction signal containing a video signal is fed to the main controller 100 from the external apparatus such as a host computer, the engine controller 110 controls an operation of each portion of the engine part 1 in accordance with a control signal from the main controller 100. At this stage, when the size of the transfer papers 4 housed in the paper feeding cassette 3 fails to match with the size designated by the print instruction signal, the operation display panel 8 shows a message which encourages to replace the paper feeding cassette. Although FIG. 12 shows the printer as a printer which comprises one paper feeding cassette 3, this is not limiting. Instead, the printer may comprise a plurality of paper feeding cassettes.

When the size of the transfer papers 4 housed in the paper feeding cassette 3 matches with the size designated by the print instruction signal (or when a plurality of paper feeding cassettes include a cassette which holds the transfer papers 4 of the size designated by the print instruction signal), by means of each laser light 16 emitted from the exposure unit 50, electrostatic latent images corresponding to the video signal described above are created on the surfaces of the photosensitive members 11 which are uniformly electrified by the electrifiers 12. Developer units 15 make the toner in the respective colors adhere to these electrostatic latent images, thereby forming toner images in the respective colors. In the respective primary transfer parts 14, thus formed toner images on the photosensitive members 11 are then primarily transferred onto the intermediate transfer belt 31 so that the toner images will be superimposed one atop the other.

In other words, the intermediate transfer belt 31 is rotated by the photosensitive member driving motor 36 at a predetermined peripheral velocity (which is the same as the transportation speed S1 for the transfer papers 4 in this embodiment), and as shown in FIG. 14, at the time of forming the first image, environment conditions are loaded and determined at the time t1. Based on the environment condition, the output value of the primary transfer bias is changed from V2 to V3 and the video request signal Vreq is outputted.

In response to the video request signal Vreq outputted at the time t, after the predetermined period T1 from the time t1, formation of an electrostatic latent image which corresponds to the video signal representing the color Y is started.

After the predetermined period T2 from the time t1, formation of an electrostatic latent image which corresponds to the video signal representing the color C is started. After the predetermined period T3 from the time t1, formation of an electrostatic latent image which corresponds to the video signal representing the color M is started. After the predetermined period T4 from the time t1, formation of an electrostatic latent image which corresponds to the video signal representing the color K is started. The predetermined periods T1, T2, T3 and T4 are determined in advance based on the distances between the respective primary transfer parts 14 and the peripheral velocity of the intermediate transfer belt 31, so that toner images on the photosensitive members 11 will be superimposed one atop the other when primarily transferred onto the intermediate transfer belt 31.

The printer according to this embodiment uses a structure of the so-called tandem type as shown in FIG. 12. Since the intermediate transfer belt 31 is fed toward the primary transfer parts 14 immediately after cleaned by the belt cleaner 33 upon secondary transfer, even when secondary transfer is still ongoing, it is possible to continuously proceed to next image formation as soon as primary transfer ends.

Noting this, at the time t2 which corresponds to the end of the first primary transfer (in Y in this example), environment conditions are loaded (#1 in FIG. 15) and whether it is necessary to change the output value of the primary transfer bias is determined (#2). When it is not necessary to change the output value (NO at #2), the same value is outputted as the output value (#3) and outputting of the video request signal Vreq is permitted (#4). This enables to perform next image formation.

On the contrary, when it is necessary to change the output value (YES at #2), outputting of the video request signal Vreq is prohibited (#5). Illustrated in FIG. 14 is a situation that it is necessary to change the output value and therefore the video request signal Vreq is not outputted at the time t2. Further, since primary transfer is still ongoing at the time t2, the output value of the primary transfer bias is not changed.

Following this, at the time t3 which corresponds to the end of the last primary transfer (which is the fourth primary transfer and transfer in K in this example), environment conditions are loaded again (#6), and whether it is necessary to change the output value of the primary transfer bias is determined (#7). When it is not necessary to change the output value (NO at #7), the sequence proceeds to #3.

On the contrary, when it is necessary to change the output value (YES at #7), whether the transfer paper 4 has been already loaded into the secondary transfer part 37 is judged (#8). When the transfer paper 4 has been already loaded into the secondary transfer part 37 (YES at #8), the printer remains on stand-by until discharging of the transfer paper 4 from the secondary transfer part 37. When the transfer paper 4 has not been loaded into the secondary transfer part 37 yet (NO at #8), the output value is changed (#9), the sequence proceeds to #4, and outputting of the video request signal Vreq is permitted. At the time t3 in FIG. 14, since it is YES at #7 and NO at #8, the output value of the primary transfer bias is changed from V3 to V2 and the video request signal Vreq is outputted.

Meanwhile, the top-most transfer paper 4 among the bundle of transfer papers housed in the paper feeding cassette 3 is taken out by the pick-up roller 61 and nipped by the gate roller pair 34. The gate clutch turns on at the time t4, which is after a predetermined period from the time t1, in synchronization to a color toner image on the intermediate transfer belt 31, and the transfer paper 4 is transported toward the secondary transfer part 37 from the gate roller pair 34 at the predetermined speed S1.

At the time t5 after a predetermined period from the time t1, application of the secondary transfer bias from the secondary transfer bias generating circuit 117 upon the secondary transfer roller 35 is activated. This realizes transfer onto the transfer paper 4 of the color image which is toner images Y, C, M and K as they are superimposed one atop the other and which was primarily transferred onto the intermediate transfer belt 31.

The gate clutch turns off after discharging of the transfer paper 4. The period during which the secondary transfer bias is applied is determined in advance in accordance with the size of the transfer papers 4. The secondary transfer bias is turned off at the time t6 which is after thus determined application period from the time t1. In the fixing unit 40, this toner image is fixed on the transfer paper 4 during transportation of the transfer paper 4. The transfer paper 4 is further discharged by the discharge roller pair 64 into the discharging part 9.

In response to the video request signal Vreq outputted at the time t3 described above, next toner images Y, C, M and K are formed, and the sequence shown in FIG. 15 is similarly executed at the time t7 (which is the end of primary transfer in the first color Y). While it is necessary to change the output value at the time t7 shown in FIG. 14, since primary transfer is still ongoing, outputting of the video request signal Vreq is prohibited.

Following this, it is judged at the time t8 (which is the end of primary transfer in the last color K) again whether it is necessary to change the output value. However, since the transfer paper 4 has been already loaded into the secondary transfer part 37 (YES at #7 and YES #8), the printer remains on stand-by. In short, the output value of the primary transfer bias is not changed and the video request signal Vreq is not outputted.

At the time t9 which is switching of the post-transfer paper sensor 65 from on to off, the primary transfer bias is changed from V2 to V1 and the video request signal Vreq is outputted. After this, the sequence shown in FIG. 15 is similarly executed at the time t10 (which is the end of primary transfer in the first color Y).

Figure 16:
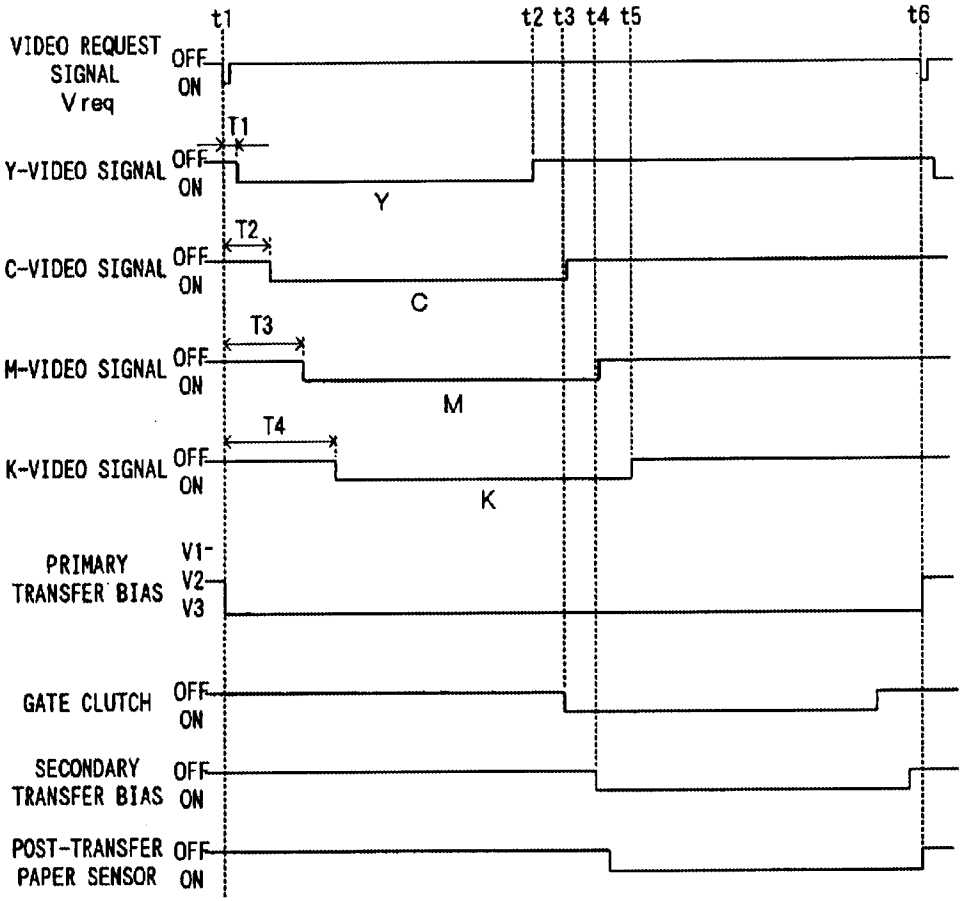
FIG. 16 is a timing chart for describing an example of different operations, which shows time-induced changes appearing in the conditions of the respective portions of an engine part.

An example of different operations of the printer will now be described with reference to FIGS. 15 and 16. FIG. 16 is a timing chart which shows time-induced changes appearing in the conditions of the respective portions of the engine part 1. The illustrated example is an example that the transfer paper size is larger than that in FIG. 14.

As in FIG. 14, toner images Y, C, M and K are formed at the predetermined timing after the time t1, and at the time t2 which corresponds to the end of the first primary transfer (in Y in this example), environment conditions are loaded (#1 in FIG. 15) and whether it is necessary to change the output value of the primary transfer bias is determined (#2). In FIG. 16, although it is necessary to change the output value, since primary transfer is still ongoing, the output value is not changed at the time t2.

Following this, the gate clutch turns on at the time t3, which is after a predetermined period from the time t1, in synchronization to a color toner image on the intermediate transfer belt 31, and at the time t4 which is after a predetermined period from the time t1, application of the secondary transfer bias from the secondary transfer bias generating circuit 117 upon the secondary transfer roller 35 is turned on. This starts secondary transfer although primary transfer is ongoing, whereby a color image, which is toner images Y, C, M and K as they are superimposed one atop the other and which was primarily transferred onto the intermediate transfer belt 31, is transferred from the front edge onto the transfer paper 4.

At the time t5 which corresponds to the end of the last primary transfer (which is the fourth primary transfer and transfer in K in this example), environment conditions are loaded again (#6 in FIG. 15). In FIG. 16, although it is determined that it is necessary to change the output value of the primary transfer bias (YES at #7), since secondary transfer which has started already is still ongoing and since it is determined that the transfer paper 4 has been already loaded into the secondary transfer part 37 (YES at #8), the output value is not changed and the printer is held off for image formation.

At the time t6 at which the post-transfer paper sensor 65, passed by the rear edge of the transfer paper 4, switches from on to off, the output value of the primary transfer bias is changed from V3 to V2 and the video request signal Vreq for next image formation is outputted.

As described above, according to this embodiment, since the output value of the primary transfer bias is changed when the transfer paper 4 has not been loaded into the secondary transfer part 37 yet, it is possible to change the output value when secondary transfer is not ongoing without fail. This makes it possible to securely prevent a change to the primary transfer bias from adversely affecting secondary transfer, and hence, the quality of an image transferred onto the transfer paper 4 from deteriorating.

Further, discharging of the transfer paper 4 from the secondary transfer part 37 is judged referring to switching of the post-transfer paper sensor 65 from on to off, and loading of the transfer paper 4 into the secondary transfer part 37 is judged based on the time required by the transfer paper 4 to arrive at the secondary transfer part 37 from the gate roller pair 34. Hence, it is possible to judge whether the transfer paper 4 has been loaded into the secondary transfer part 37 or not without fail.

In addition, since environment conditions fed from the temperature sensor 6 and the humidity sensor 7 are judged and the output value of the primary transfer bias is changed in accordance with the result of the judgment, it is possible to perform primary transfer in an excellent manner independently of a change in transfer efficiency.

The present invention is not limited to the preferred embodiments described above. The preferred embodiments described above may be modified in various manners to the extent not deviating from the object of the invention.

For instance, although the preferred embodiments described above use the intermediate transfer belt 31 which is formed by an endless belt which does not have a splice, the intermediate transfer medium of the present invention is not limited to this. Instead, the intermediate transfer medium may be an intermediate transfer drum which has a cylindrical shape.

Further, although the preferred embodiments described above require to change the output value of the primary transfer bias in accordance with detection results of both the temperature sensor 6 and the humidity sensor 7, this is not limiting. For example, only one of the temperature sensor 6 and the humidity sensor 7 may be disposed and the output value may be changed in accordance with a detection result of the temperature sensor 6 or the humidity sensor 7.

The sequence of changing the output value of the primary transfer bias is not limited to the routine which is shown in FIG. 15. For instance, #6 and #7 may be omitted so as to proceed directly to #8 at the end of the last primary transfer. Alternatively, environment conditions may be loaded after YES at #8 and stand-by until discharging of the transfer paper 4 from the secondary transfer part 37 and whether it is necessary to change the output value may then be determined.

Further, while the foregoing has described the preferred embodiments above in relation to a color printer of the so-called tandem type in which the plurality of photosensitive members 11 are disposed one next to the other along the intermediate transfer belt 31, this is not limiting. The preferred embodiments above may be applied to a monochrome printer which comprises one photosensitive member.

<Other>

The present invention is not limited to the preferred embodiments above. The preferred embodiments may be modified in various manners to the extent not deviating from the object of the invention.

In addition, while the foregoing has described the preferred embodiments above in relation to a printer which prints on a transfer paper an image which is fed from an external apparatus such as a host computer. The present invention is not limited to this, but may be applied to an electrophotographic image forming apparatus in a general use, such as a printer, a copier machine and a facsimile machine.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus in which a toner image formed on a photosensitive member is transferred onto a transfer paper through an intermediate transfer medium which comprises a plurality of layers including a conductive layer and which moves from a primary transfer part to a secondary transfer part by rotation, said apparatus comprising:

primary transfer means which primarily transfers said toner image from said photosensitive member onto said intermediate transfer medium in said primary transfer part by applying a primary transfer bias which is determined in advance upon said conductive layer of said intermediate transfer medium;

secondary transfer means which secondarily transfers said toner image now on said intermediate transfer medium onto a transfer paper in said secondary transfer part;

bias control means which changes an output value of said primary transfer bias in accordance with a predetermined bias change condition when secondary transfer is not ongoing;

reference detecting means which detects a reference mark formed on said intermediate transfer medium and outputs a reference signal; and toner image formation control means which controls toner image formation on said photosensitive member based on said reference signal, wherein said bias control means changes said output value after an elapsed period which is determined in advance since outputting of said reference signal, so that said output value is changed when a non-image area, in medium, is passing said primary transfer part, and said elapsed period is set so that said output value is changed before said non-image area has finished passing said primary transfer part.

2. The image forming apparatus of claim 1, further comprising:

bias change judging means which judges, at the time of outputting of said reference signal, whether it is necessary to change said output value in accordance with said bias change condition; and second transfer judging means which judges, when said bias change judging means determines that it is necessary to change said output value, whether secondary transfer is ongoing after said elapsed period since said outputting, wherein when said second transfer judging means judges that secondary transfer is ongoing after said elapsed period since said outputting, said toner image formation control means holds off next toner image formation for a stand-by period which is determined in advance.

3. The image forming apparatus of claim 2, wherein said stand-by period is a period of time at least until detection of the next reference mark by said reference detecting means.

4. The image forming apparatus of claim 2, wherein a transfer area of said intermediate transfer medium has a plurality of sub areas onto each one of which a toner image of a predetermined size is transferred, and said stand-by period is a period of time during which said intermediate transfer medium rotates an amount equivalent to at least one of said sub areas.

5. The image forming apparatus of claim 1, wherein said bias control means uses, as said bias change condition, at least either one value of the temperature of an atmosphere and the humidity level of the atmosphere.

6. The image forming apparatus of claim 1, further comprising image formation control means which controls image formation on said photosensitive member to toner images in different colors one after another, wherein said intermediate transfer medium is for ensuring that said toner images in the respective colors are primarily transferred onto said intermediate transfer medium every time each toner image in each color is formed and said toner images are accordingly superimposed one atop the other, and said bias control means uses, as said bias change condition, the order of said toner images superimposed one atop the other on said intermediate transfer medium, and changes said output value between during primary transfer of the first toner image and during primary transfer of the last toner image.

7. An image forming apparatus in which a toner image formed on a photosensitive member is transferred onto a transfer paper through an intermediate transfer medium which comprises a plurality of layers including a conductive layer and which moves from a primary transfer part to a secondary transfer part by rotation, said apparatus comprises:

primary transfer means which primarily transfers said toner image from said photosensitive member onto said intermediate transfer medium in said primary transfer part by applying a primary transfer bias which is determined in advance upon said conductive layer of said intermediate transfer medium;

secondary transfer means which secondarily transfers said toner image now on said intermediate transfer medium onto a transfer paper in said secondary transfer part; and bias control means which changes an output value of said primary transfer bias in accordance with a predetermined bias change condition when secondary transfer is not ongoing, wherein a distance between said primary transfer part and said secondary transfer part is shorter than the size of a transfer protection area, in which primary transfer of a toner image is prohibited and which is provided along a direction of rotation axis, along a direction of rotational driving, and said bias control means changes said output value when said transfer protection area is passing both said primary transfer part and said secondary transfer part.

8. An image forming apparatus in which a toner image formed on a photosensitive member is transferred onto a transfer paper through an intermediate transfer medium which comprises a plurality of layers including a conductive layer and which moves from a primary transfer part to a secondary transfer part by rotation, said apparatus comprises:

primary transfer means which primarily transfer said toner image from said photosensitive member onto said intermediate transfer medium in said primary transfer part by applying a primary transfer bias which is determined in advance upon said conductive layer of said intermediate transfer medium;

secondary transfer means which secondarily transfers said toner image now on said intermediate transfer medium onto a transfer paper in said secondary transfer part;

bias control means which changes an output value of said primary transfer bias in accordance with a predetermined bias change condition when secondary transfer is not ongoing; and image formation control means which controls formation of toner images in N pieces of colors (N is a positive integer) one after another on said photosensitive member, controls said primary transfer means to primarily transfer said toner images onto said intermediate transfer medium one after another and superimposes one atop the other every time each toner image in each color is formed, and controls said secondary transfer means to secondarily transfer onto a transfer paper a toner image which is said toner images in said N pieces of colors superimposed one atop the other, wherein said bias control means uses, as said bias change condition, the order of said toner images superimposed one atop the other on said intermediate transfer medium, and changes said output value between during primary transfer of said toner image in the first color and during primary transfer of said toner image in the N-th color, and executes said output value change after the end of secondary transfer onto said transfer paper but before primary transfer of the next toner image in the first color.

9. The image forming apparatus of claim 8, wherein said bias control means changes said output value also at the time of primary transfer of said toner images in each color.

10. The image forming apparatus of claim 8, further comprising completion judging means which judges end timing of secondary transfer onto said transfer paper based on the size of said transfer paper, wherein said image formation control means starts an operation of image formation on said photosensitive member during execution of said secondary transfer so that the next toner image in the first color on said photosensitive member will arrive at said primary transfer part immediately after said end timing which is judged by said completion judging means.

11. An image forming apparatus in which a toner image formed on a photosensitive member is transferred onto a transfer paper through an intermediate transfer medium which comprises a plurality of layers including a conductive layer and which moves from a primary transfer part to a secondary transfer part by rotation, said apparatus comprises:

primary transfer means which primarily transfers said toner image from said photosensitive member onto said intermediate transfer medium in said primary transfer part by applying a primary transfer bias which is determined in advance upon said conductive layer of said intermediate transfer medium;

secondary transfer means which secondarily transfers said toner image now on said intermediate transfer medium onto a transfer paper in said secondary transfer part;

bias control means which changes an output value of said primary transfer bias in accordance with a predetermined bias change condition when secondary transfer is not ongoing; and transfer paper judging means which judges whether said transfer paper has been already loaded into said secondary transfer part, wherein said bias control means changes said output value when said transfer paper judging means judges that said transfer paper has not been loaded into said secondary transfer part yet.

12. The image forming apparatus of claim 11, wherein said bias control means uses, as said bias change condition, at least either one value of the temperature of an atmosphere and the humidity level of the atmosphere.

13. The image forming apparatus of claim 11, comprising a plurality of photosensitive members which are disposed to face with said intermediate transfer medium along a direction of rotational driving of said intermediate transfer medium and on which toner images in mutually different colors are formed, and image formation control means which controls image formation on said photosensitive members so that primarily transferred toner images in the respective colors will be superimposed one atop the other on said intermediate transfer medium, wherein when it is necessary to change said output value in accordance with said bias change condition and said transfer paper has been already loaded into said secondary transfer part, said image formation control means keeps next image formation on stand-by until said transfer paper has been discharged from said secondary transfer part.

14. The image forming apparatus of claim 13, further comprising bias change judging means which judges whether it is necessary to change said output value in accordance with said bias change condition, wherein when said transfer paper judging means judges that said transfer paper has been already loaded into said secondary transfer part when said bias change judging means determines that it is necessary to change said output value, said bias control means changes said output value after said transfer paper has been discharged from said secondary transfer part, and said image formation control means starts next image formation after said output value is changed by said bias control means.

15. An image forming method in which a toner image formed on a photosensitive member is transferred onto a transfer paper through an intermediate transfer medium which comprises a plurality of layers including a conductive layer and which moves from a primary transfer part to a secondary transfer part by rotation, said comprising:

primary transferring step of transferring said toner image from said photosensitive member onto said intermediate transfer medium in said primary transfer part by applying a primary transfer bias which is determined in advance upon said conductive layer of said intermediate transfer medium;

secondary transferring step of transferring said toner image now on said intermediate transfer medium onto a transfer paper in said secondary transfer part;

bias changing step of changing an output value of said primary transfer bias in accordance with a predetermined bias change condition when secondary transfer is not ongoing, reference detecting step of detecting a reference mark formed on said intermediate transfer medium and outputting a reference signal; and toner image formation controlling step of controlling toner image formation on said photosensitive member based on said reference signal, wherein at said bias changing step, said output value is changed after an elapsed period which is determined in advance since outputting of said reference signal, so that said output value is changed when a non-image area, in which there is no toner image transferred on said intermediate transfer medium, is passing said primary transfer part, and said elapsed period is set so that said output value is changed before said non-image area has finished passing said primary transfer part.

16. An image forming method in which a toner image formed on a photosensitive member is transferred onto a transfer paper through an intermediate transfer medium which comprises a plurality of layers including a conductive layer and which moves from a primary transfer part to a secondary transfer part by rotation, said method comprising;

primary transferring step of transferring said toner image from said photosensitive member onto said intermediate transfer medium in said primary transfer part by applying a primary transfer bias which is determined in advance upon said conductive layer of said intermediate transfer medium;

secondary transferring step of transferring said toner image now on said intermediate transfer medium onto a transfer paper in said secondary transfer part;

bias changing step of changing an output value of said primary transfer bias in accordance with a predetermined bias change condition when secondary transfer is not ongoing; and image formation controlling step of controlling formation of toner images in N pieces of colors (N is a positive integer) one after another on said photosensitive member, wherein at said primary transferring step, said toner images are primarily transferred onto said intermediate transfer medium one after another and are superimposed one atop the other every time each toner image in each color is formed, and at said secondary transferring step, a toner image which is said toner images in said N pieces of colors superimposed one atop the other is transferred onto said transfer paper, and at said bias changing step, as said bias change condition, the order of said toner images superimposed one atop the other on said intermediate transfer medium is used, and said output value is changed between during primary transfer of said toner image in the first color and during primary transfer of said toner image in the N-th color, and said output value change is executed after the end of secondary transfer onto said transfer paper but before primary transfer of the next toner image in the first color.

17. An image forming method in which a toner image formed on a photosensitive member is transferred onto a transfer paper through an intermediate transfer medium which comprises a plurality of layers including a conductive layer and which moves from a primary transfer part to a secondary transfer part by rotation, said method comprises:

primary transferring step of transferring said toner image from said photosensitive member onto said intermediate transfer medium in said primary transfer part by applying a primary transfer bias which is determined in advance upon said conductive layer of said intermediate transfer medium;

secondary transferring step of transferring said toner image now on said intermediate transfer medium onto a transfer paper in said secondary transfer part; and bias changing step of changing an output value of said primary transfer bias in accordance with a predetermined bias change condition when secondary transfer is not ongoing;

wherein at said bias changing step, said output value is changed when said transfer paper has not been loaded into said secondary transfer part yet.

* * * * *

UNITED STATES PATENT AND TRADEMARK OFFICE

CERTIFICATE OF CORRECTION

PATENT NO. : 6,801,728 B2 
DATED : October 5, 2004
INVENTOR(S) : Keiichi Taguchi and Toshihiko Yamazaki It is certified that error appears in the above-identified patent and that said Letters Patent is hereby corrected as shown below:

Title page,
Item [56], References Cited, U.S. PATENT DOCUMENTS, the issue date for U.S. Patent No. 6,330,407 is changed to -- 12/2001 --, rather than "9/2000".

Signed and Sealed this

Twentieth Day of September, 2005

JON W. DUDAS
*Director of the United States Patent and Trademark Office*